US008381736B2

(12) United States Patent
White et al.

(10) Patent No.: US 8,381,736 B2
(45) Date of Patent: Feb. 26, 2013

(54) METHOD OF PREPARING A ROD FOR USE IN THE PREPARATION OF A SMOKING ARTICLE

(75) Inventors: Peter Rex White, Southampton (GB); William David Lewis, Southampton (GB)

(73) Assignee: British America Tobacco (Investments) Limited, London (GB)

( * ) Notice: Subject to any disclaimer, the term of this patent is extended or adjusted under 35 U.S.C. 154(b) by 794 days.

(21) Appl. No.: 12/162,328

(22) PCT Filed: Jan. 24, 2007

(86) PCT No.: PCT/GB2007/000246

§ 371 (c)(1),
(2), (4) Date: Feb. 18, 2009

(87) PCT Pub. No.: WO2007/085830

PCT Pub. Date: Aug. 2, 2007

(65) Prior Publication Data

US 2009/0301503 A1 Dec. 10, 2009

(30) Foreign Application Priority Data

Jan. 27, 2006 (GB) ..... 0601699.2
Mar. 17, 2006 (GB) ..... 0605459.7

(51) Int. Cl.
*A24C 5/18* (2006.01)

(52) U.S. Cl. ..... 131/84.1; 131/88; 131/335; 493/49; 493/39

(58) Field of Classification Search ..... 131/284, 131/27.1, 77, 31, 84.1, 335, 88; 493/39, 493/49

See application file for complete search history.

(56) References Cited

U.S. PATENT DOCUMENTS 3,006,347 A 10/1961 Keaton
3,162,199 A 12/1964 Moll, Jr.
4,185,645 A 1/1980 Boegli et al.
4,281,671 A * 8/1981 Bynre et al. ..... 131/335

(Continued)

FOREIGN PATENT DOCUMENTS

EP 0 404 580 A1 12/1990
EP 0490559 A1 6/1992

(Continued)

OTHER PUBLICATIONS

International Search Report and Written Opinion, mailed May 8, 2007, for PCT International Application No. PCT/GB2007/000246, filed Jan. 24, 2007.

(Continued)

*Primary Examiner* — Richard Crispino
*Assistant Examiner* — Dionne Walls Mayes
(74) *Attorney, Agent, or Firm* — Cooley LLP

(57) ABSTRACT

A method of preparing a rod for use in the preparation of a smoking article is described. The rod has a first end and a second end. The rod has located therein a solid support. The solid support extends in a linear fashion from the first end of said rod to the second end of said rod. At least a portion of said solid support is coated and/or impregnated with an additive. The rod is prepared using rod forming means, wherein said rod forming means comprises a channel ending in an open exit, wherein material may pass through at least part of the channel and leave via the open exit in the form of a rod.

63 Claims, 10 Drawing Sheets

U.S. PATENT DOCUMENTS

Figure 1A:
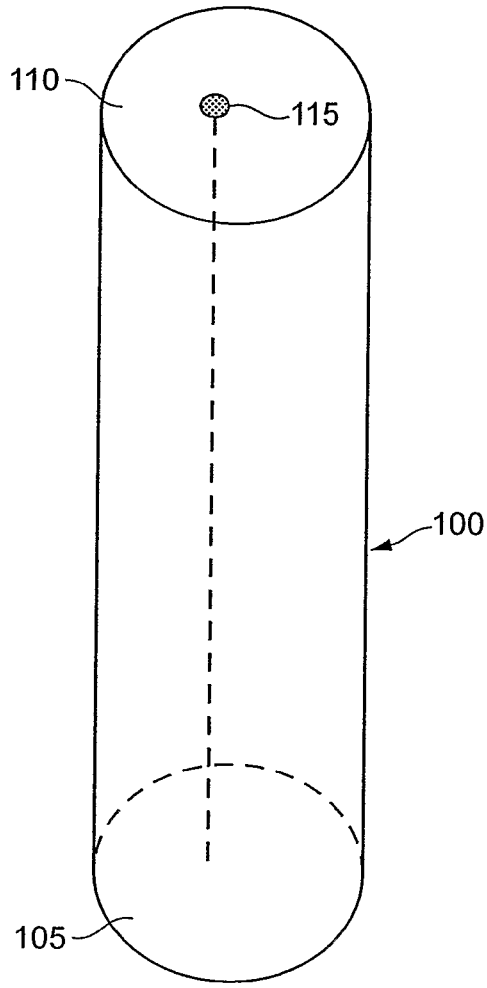

| | | | | |
|---|---|---|---|---|
| 2003/0098029 | A1 | 5/2003 | Wolff | |
| 2003/0224918 | A1 * | 12/2003 | Lanier et al. | 493/39 |

FOREIGN PATENT DOCUMENTS

| | | | |
|---|---|---|---|
| EP | 0558447 | A | 9/1993 |
| GB | 1087909 | | 10/1967 |
| GB | 2007078 | A | 5/1979 |
| GB | 2070409 | A | 9/1981 |
| GB | 2078488 | A | 1/1982 |
| GB | 2 249 936 | | 5/1992 |
| GB | 2260887 | A | 5/1993 |
| WO | 96/07336 | A2 | 3/1996 |
| WO | 01/41590 | A1 | 6/2001 |
| WO | 03/051144 | A1 | 6/2003 |
| WO | 2005/096851 | A | 10/2005 |

OTHER PUBLICATIONS

Standard Search Report, dated May 8, 2006, for GB 0601699.2, filed Jan. 27, 2006.

International Preliminary Report on Patentability, issued Jul. 29, 2008 for PCT/GB2007/000246, filed Jan. 24, 2007.

* cited by examiner (END VIEW)

METHOD OF PREPARING A ROD FOR USE IN THE PREPARATION OF A SMOKING ARTICLE

CLAIM FOR PRIORITY

This application is a National Stage Entry entitled to and hereby claims priority under 35 U.S.C. §§365 and 371 corresponding to PCT Application No. PCT/GB2007/000246, titled, "METHOD," filed Jan. 24, 2007, which in turn claimed priority to British Application Serial No. 0601699.2, filed Jan. 27, 2006, and British Application Serial No. 0605459.7, filed Mar. 17, 2006; all of which is hereby incorporated by reference.

The present invention relates to a method and to an apparatus for use in same. The present invention also relates to articles made by said method.

In particular, the present invention relates to a method of forming a rod for use in the preparation of a smoking article.

PRIOR ART

Rods with threads therein for use as filter rods are known. Examples of such rods are taught in U.S. Pat. No. 4,281,671 and US 2005/0255978. There are a number of problems associated with the methods disclosed therein for preparing the rod articles. For example, the methodology taught in U.S. Pat. No. 4,281,671 does not reliably allow manufacturers to accurately place the threads inside the rods. If—for example—it was desirous to have the thread running along the central axis of the rod then the method taught in U.S. Pat. No. 4,281,671 does not allow workers to create with some degree of accuracy such embodiments, meaning that the threads are prone to being off-centre. This can result in uneven migration of the menthol—which in some cases can result in spotting or similar spoilage of the casings or coverings or wrappers wrapped around filters etc. A problem with the methodology taught in US 2005/0255978 is that it is not best suited for the application of volatile flavourants, such as menthol, since the flavourants are coated onto the solid support at a location quite remote from the rod forming means.

The present invention seeks to overcome these problems. In this respect, the present invention provides a method of preparing a rod having therein a solid support wherein the solid support may be more accurately located inside of the rod and wherein the support comprises and/or has coated thereon an additive.

GB-A-2 070 409 discloses a method of producing a smoking material rod wherein smoking material, a filament comprising a smoke-modifying agent and a wrapper web are fed to a rod-forming device of a rod making machine in order to produce a wrapped rod incorporating the filament. However, the smoke-modifying agent is coated onto the filament prior to entry of the filament into the garniture of the rod making machine.

WO 2005/096851 discloses a method for preparing smoking articles wherein an extrudate is formed and applied to scattered tobacco. The extrudate contains a base constituent to which an additive has been discontinuously supplied. The additive is, therefore, applied remote from the tobacco rolling or rod forming means.

PRESENT INVENTION

Features and aspects of the present invention will now be described under different sections. It is to be noted that the teachings in each section are applicable to all of the other sections.

GENERAL ASPECTS

The smoking article of the present invention comprises smokable material (sometimes referred to as "smoking material") wrapped in a wrapper.

The term 'smokable material' means any material which can be used in a smoking article. It does not necessarily mean that the material itself will necessarily sustain combustion. The smokable material may be tobacco material or may, alternatively be a tobacco substitute material. A tobacco substitute material is usually produced as a sheet, and then cut to resemble cut tobacco. The smokable material may then be blended with other materials to produce a smokable filler material.

The smokable material is typically retained in the form of a rod, commonly known as a smokable material rod or a smoking material rod. These terms are merely intended to mean that part of the smoking article which is contained within the wrapper (which may be a paper or other wrapper, which other wrapper may or may not be combustible) and should not have imported therein any association as to the combustibility or otherwise of individual components of the rod of the smoking material.

The smoking article of the present invention may take any form. For example the smoking article may be one in which the tobacco is smoked by igniting the smoking material and inhaling the products of combustion, as for example in a cigarette, cigar or cigarillo. Alternatively the smoking article may be one in which the smoking material is heated to a temperature at which decomposition in to pyrolysis products occurs without combustion. Such articles are well known and incorporate electrical or other heating means such as a charcoal element.

The preferred smoking article of the present invention is a cigarette comprising a rod of tobacco, a wrapper, and a smoke filter wherein the filter comprises the rod of the present invention.

In particular the smoking article of the present invention may comprise a rod of smoking material optionally in a casing, with or without a filter. The casing may be a wrapper of paper, tobacco leaf or reconstituted tobacco. Alternatively, where, for example, the smoking article is intended to produce low emissions of sidestream smoke, or lower levels of pyrolysis products in the mainstream smoke, the casing may be composed of non-combustible inorganic material such as a ceramic material. The filter may be of any suitable material, for example fibrous cellulose acetate, polypropylene or polyethylene, or paper.

The rod of the present invention has a first end and a second end. Located in the rod is a solid support. The solid support extends in a linear fashion from the first end of said rod to the second end of said rod.

Examples of solid supports for use in the present invention include textile materials and other suitable materials. The solid supports may be in the form of threads or tapes. The solid supports may be coated or impregnated with flavourants, in particular menthol if the smoking article is a cigarette.

BROAD ASPECTS

In a broad aspect, the present invention provides a method of preparing a rod for use in the preparation of a smoking article. The rod has a first end and a second end. The rod has located therein a solid support. The solid support extends in a linear fashion from the first end of said rod to the second end of said rod. At least a portion of said solid support is coated and/or impregnated with an additive. The rod is prepared using rod forming means, wherein said rod forming means comprises a channel ending in an open exit, wherein material may pass through at least part of the channel and leave via the open exit in the form of a rod. The rod is prepared by: (i) providing starting material for forming said rod; (ii) providing the solid support for location within said formed rod; (iii) providing an additive for coating and/or impregnating at least a portion of said solid support; wherein the initial contact of the solid support with the additive occurs in said rod forming means. The method includes contacting a section of said starting material with a section of said solid support; wherein the initial contact of said section of starting material with said section of said solid support occurs in said rod forming means.

In accordance with the present invention, the rod is prepared by: (i) providing starting material for forming said rod; (ii) providing the solid support for location within said formed rod; (iii) providing an additive for coating and/or impregnating at least a portion of said solid support; wherein the initial contact of the solid support with the additive occurs in said rod forming means. The method includes contacting a section of said starting material with a section of said solid support; wherein the initial contact of said section of starting material with said section of said solid support occurs in said rod forming means.

Thus, in this broad aspect, the present invention provides a method of preparing a rod for use in the preparation of a smoking article; wherein the rod has a first end and a second end; wherein the rod has located therein a solid support; wherein the solid support extends in a linear fashion from the first end of said rod to the second end of said rod; wherein at least a portion of said solid support is coated and/or impregnated with an additive; wherein the rod is prepared using rod forming means, wherein said rod forming means comprises a channel ending in an open exit, wherein material may pass through at least part of the channel and leave via the open exit in the form of a rod; wherein the rod is prepared by: (i) providing starting material for forming said rod; (ii) providing the solid support for location within said formed rod; (iii) providing an additive for coating and/or impregnating at least a portion of said solid support; wherein the initial contact of the solid support with the additive occurs in said rod forming means; and (iv) contacting a section of said starting material with a section of said solid support; wherein the initial contact of said section of starting material with said section of said solid support occurs in said rod forming means.

In another broad aspect, the present invention provides an apparatus for use in such a method. In this respect, the present invention provides an apparatus for preparing a rod suitable for use in the preparation of a smoking article; wherein said rod has a first end and a second end; wherein said rod has located therein a solid support; wherein the solid support extends in a linear fashion from the first end of said rod to the second end of said rod; wherein at least a portion of said solid support is coated and/or impregnated with an additive; wherein said apparatus comprises a rod forming means; wherein said rod forming means comprises: means for providing starting material for forming said rod; means for providing the solid support for location within said formed rod; means for providing an additive for coating and/or impregnating at least a portion of said solid support; means for coating and/or impregnating at least a portion of said solid support with said additive within said channel, wherein the initial contact of the solid support with the additive occurs in said rod forming means; means for allowing a section of said starting material to contact a section of said solid support coated and/or impregnated with said additive within said channel, wherein the initial contact of said section of starting material with said section of said solid support occurs in said rod forming means.

The means may be separate means. Alternatively, two or more of the means may be the same.

As used herein in connection with the present invention, the term "rod forming means" refers to that part of a rod making apparatus in which the rod of starting material is formed.

PREFERRED ASPECTS

According to a first aspect of the present invention there is provided a method of preparing a rod for use in the preparation of a smoking article;

wherein said rod has a first end and a second end;

wherein said rod has located therein a solid support;

wherein the solid support extends in a linear fashion from the first end of said rod to the second end of said rod;

wherein at least a portion of said solid support is coated and/or impregnated with an additive;

wherein said rod is prepared using rod forming means, wherein said rod forming means comprises a channel ending in an open exit, wherein material may pass through at least part of the channel and leave via the open exit in the form of a rod;

wherein said rod is prepared by:

(i) providing starting material for forming said rod;

(ii) providing the solid support for location within said formed rod;

(iii) providing an additive for coating and/or impregnating at least a portion of said solid support;

(iv) allowing said starting material to travel through at least part of said channel of said rod forming means;

(v) coating and/or impregnating at least a portion of said solid support with said additive within said channel;

(vi) allowing said solid support coated and/or impregnated with said additive to travel through at least part of channel of said rod forming means;

wherein said method comprises:

(a) contacting a section of said starting material with a section of said solid support;

wherein the initial contact of said section of starting material with said section of said solid support occurs in said rod forming means;

(b) allowing the contacted sections of starting material and solid support to travel through at least part of said channel of said rod forming means in the direction of said open exit;

(c) allowing the remainder of the starting material and the remainder of the solid support to contact in the rod forming means;

(d) allowing the contacted remainder of the starting material and the solid support to travel through at least part of said channel of said rod forming means;

(e) forming said rod by said rod forming means, such that on forming said rod said solid support extends within said rod from the first end of said rod to the second end of said rod; and (f) allowing said formed rod to exit from said open exit.

According to a second aspect of the present invention there is provided an apparatus for preparing a rod suitable for use in the preparation of a smoking article;

wherein said rod has a first end and a second end;

wherein said rod has located therein a solid support;

wherein the solid support extends in a linear fashion from the first end of said rod to the second end of said rod;

wherein at least a portion of said solid support is coated and/or impregnated with an additive;

wherein said rod forming means comprises:

(i) a channel ending in an open exit (ii) means for allowing material to pass through at least part of the channel and leave via the open exit in the form of a rod;

(iii) means for providing starting material for forming said rod;

(iv) means for providing the solid support for location within said formed rod;

(v) means for providing an additive for coating and/or impregnating at least a portion of said solid support;

(vi) means for coating and/or impregnating at least a portion of said solid support with said additive within said channel;

(vii) means for allowing a section of said starting material to contact a section of said solid support coated and/or impregnated with said additive within said channel;

(viii) means for allowing said solid support coated and/or impregnated with said additive to travel through at least part of said channel of said rod forming means;

(ix) means for allowing said formed rod to exit from said open exit.

The means may be separate means. Alternatively, two or more of the means may be the same.

According to a third aspect of the present invention there is provided an apparatus for preparing a rod suitable for use in the preparation of a smoking article;

wherein said rod has a first end and a second end;

wherein said rod has located therein a solid support;

wherein the solid support extends in a linear fashion from the first end of said rod to the second end of said rod;

wherein at least a portion of said solid support is coated and/or impregnated with an additive;

wherein said rod forming means comprises:

(i) a channel ending in an open exit (ii) means for allowing material to pass through at least part of the channel and leave via the open exit in the form of a rod;

(iii) means for providing starting material for forming said rod;

(iv) means for providing the solid support for location within said formed rod;

(v) means for providing an additive for coating and/or impregnating at least a portion of said solid support;

(vi) means for coating and/or impregnating at least a portion of said solid support with said additive within said channel;

(vii) means for allowing a section of said starting material to contact a section of said solid support coated and/or impregnated with said additive within said channel;

(viii) means for allowing said solid support coated and/or impregnated with said additive to travel through at least part of said channel of said rod forming means;

(ix) means for allowing said formed rod to exit from said open exit;

wherein said rod forming means comprises a garniture having a channel;

wherein the initial coating or impregnation of said portion of said solid support with an additive occurs whilst the solid support is located in the garniture; and wherein the initial contact of the solid support with said starting material occurs whilst the starting material is located in the garniture.

The means may be separate means. Alternatively, two or more of the means may be the same.

According to a third aspect of the present invention there is provided a rod obtained by the method according to the present invention.

According to a fourth aspect of the present invention there is provided a method of forming a smoking article comprising using the method of the present invention or a rod according to the present invention.

HIGHLY PREFERRED ASPECTS

In a highly preferred aspect there is provided a method of preparing a rod for use in the preparation of a smoking article;

wherein said rod has a first end and a second end;

wherein said rod has located therein a solid support;

wherein the solid support extends in a linear fashion from the first end of said rod to the second end of said rod;

wherein at least a portion of said solid support is coated and/or impregnated with an additive;

wherein said rod is prepared using rod forming means, wherein said rod forming means comprises a channel ending in an open exit, wherein material may pass through at least part of the channel and leave via the open exit in the form of a rod;

wherein said rod is prepared by:

(i) providing starting material for forming said rod;

(ii) providing the solid support for location within said formed rod;

(iii) providing an additive for coating and/or impregnating at least a portion of said solid support;

(iv) allowing said starting material to travel through at least part of said channel of said rod forming means;

(v) coating and/or impregnating at least a portion of said solid support with said additive within said channel;

(vi) allowing said solid support coated and/or impregnated with said additive to travel through at least part of said channel of said rod forming means;

wherein said method comprises:

(a) contacting a section of said starting material with a section of said solid support;

wherein the initial contact of said section of starting material with said section of said solid support occurs in said rod forming means;

(b) allowing the contacted sections of starting material and solid support to travel through at least part of said channel of said rod forming means in the direction of said open exit;

(c) allowing the remainder of the starting material and the remainder of the solid support to contact in the rod forming means;

(d) allowing the contacted remainder of the starting material and the solid support to travel through at least part of said channel of said rod forming means;

(e) forming said rod by said rod forming means, such that on forming said rod said solid support extends within said rod from the first end of said rod to the second end of said rod; and (f) allowing said formed rod to exit from said open exit;

wherein said rod forming means comprises a garniture defining said channel;

wherein the initial coating or impregnation of said portion of said solid support with an additive occurs whilst the solid support is located in said garniture; and wherein the initial contact of the solid support with said starting material occurs whilst the starting material is located in said garniture.

In another highly preferred aspect there is provided a method of preparing a rod for use in the preparation of a smoking article;

wherein said rod has a first end and a second end;

wherein said rod has located therein a solid support;

wherein the solid support extends in a linear fashion from the first end of said rod to the second end of said rod;

wherein at least a portion of said solid support is coated and/or impregnated with an additive;

wherein said rod is prepared using a rod forming means, wherein said rod forming means comprises a garniture defining a channel ending in an open exit, wherein material may pass through at least part of the channel and leave via the open exit in the form of a rod;

wherein said rod is prepared by:

(i) providing starting material for forming said rod;

(ii) providing the solid support for location within said formed rod;

(iii) providing an additive for coating and/or impregnating at least a portion of said solid support;

(iv) allowing said starting material to travel through at least part of said channel of said rod forming means;

(v) coating and/or impregnating at least a portion of said solid support with said additive within said channel;

(vi) allowing said solid support coated and/or impregnated with said additive to travel through at least part of said channel of said rod forming means;

wherein said method comprises:

(a) contacting a section of said starting material with a section of said solid support;

wherein the initial contact of said section of starting material with said section of said solid support occurs when the starting material is located in the garniture;

(b) allowing the contacted sections of starting material and solid support to travel through at least part of said channel of said rod forming means in the direction of said open exit;

(c) allowing the remainder of the starting material and the remainder of the solid support to contact in the rod forming means;

(d) allowing the contacted remainder of the starting material and the solid support to travel through at least part of said channel of said rod forming means;

(e) forming said rod by said rod forming means, such that on forming said rod said solid support extends within said rod from the first end of said rod to the second end of said rod; and (f) allowing said formed rod to exit from said open exit;

wherein the initial coating or impregnation of said portion of said solid support with an additive occurs whilst the solid support is located in the garniture; and wherein the initial contact of the solid support with said starting material occurs whilst the starting material is located in the garniture.

In another highly preferred aspect there is provided an apparatus for preparing a rod suitable for use in the preparation of a smoking article;

wherein said rod has a first end and a second end;

wherein said rod has located therein a solid support;

wherein the solid support extends in a linear fashion from the first end of said rod to the second end of said rod;

wherein at least a portion of said solid support is coated and/or impregnated with an additive;

wherein said rod forming means comprises:

(i) a channel ending in an open exit (ii) means for allowing material to pass through at least part of the channel and leave via the open exit in the form of a rod;

(iii) means for providing starting material for forming said rod;

(iv) means for providing the solid support for location within said formed rod;

(v) means for providing an additive for coating and/or impregnating at least a portion of said solid support;

(vi) means for coating and/or impregnating at least a portion of said solid support with said additive within said channel;

(vii) means for allowing a section of said starting material to contact a section of said solid support coated and/or impregnated with said additive within said channel;

(viii) means for allowing said solid support coated and/or impregnated with said additive to travel through at least part of said channel of said rod forming means;

(ix) means for allowing said formed rod to exit from said open exit wherein said rod forming means comprises a garniture defining a channel;

wherein the initial coating or impregnation of said portion of said solid support with an additive occurs whilst the solid support is located in the garniture; and wherein the initial contact of the solid support with said starting material occurs whilst the starting material is located in the garniture.

The means may be separate means. Alternatively, two or more of the means may be the same.

ADVANTAGES

One of the key differences between the method (and apparatus) of the present invention and method (and apparatus) of U.S. Pat. No. 4,281,671 and US 2005/0255978 lies in the initial contact between the starting material and the solid support material. In the case of U.S. Pat. No. 4,281,671, that initial contact occurs remote from the rod forming means. In the present invention, the initial contact takes place in the rod forming means. This has many advantages. For example, after contact the ability for the solid support material to move for example laterally is minimised—which means that workers can more accurately place the support material inside the rod. In the case of U.S. Pat. No. 4,281,671, the solid support material can move easily in a lateral direction, making the alignment prone to error etc. In addition, if the support material is impregnated with volatile flavourants—such as menthol—then with the present invention one can achieve higher dosing of the flavourant in the rod. This is because the flavourant does not have to travel very far—relative to the distances of the methodology taught in U.S. Pat. No. 4,281,671 and US 2005/0255978—to be encapsulated in the rod. In addition, with the present invention it is possible to use pure flavourants—such as pure menthol for the method; thereby minimising the use of carrier solvents etc. for the flavourant. In some instances, it may be possible to load the support material with sufficient flavourant thereby reducing or even eliminating the need to also load the tobacco with flavourant. Other advantages will be apparent to those skilled in the art in the light of the following commentary.

SOME PREFERABLE FEATURES

Preferred features are defined in the accompanying claims and in the following commentary.

Preferably all of said solid support is coated with an additive.

Preferably at least a part of the external surface of said rod is covered with a cover.

Preferably said cover is paper.

Preferably the edges of said cover are fixed to each other by means of an adhesive.

Preferably said adhesive is a hot melt adhesive.

Preferably said rod is subsequently cut into a smaller rod for use in the preparation of a smoking article.

Preferably said rod or smaller rod is a filter rod.

Preferably said smoking article is a cigarette.

Preferably said support material enters the rod forming means via a port that is operably linked to the channel.

Preferably said solid support is positioned along the central longitudinal axis of the rod.

Preferably the additive is a smoke-modifying agent.

Preferably the additive is a flavourant.

Preferably the additive is a flavourant in substantially pure form.

Preferably said additive is menthol.

Preferably at least one end of the solid material is at one end of the rod.

Preferably the ends of the solid material are at opposite ends of the rod.

Preferably said section of said starting material is an end of said starting material.

Preferably said section of said solid support is an end of said solid support.

Preferably said starting material enters the channel at an open entrance opposite the open exit.

Preferably said channel is conical.

Preferably said rod forming means is formed from at least two components that operably engage each other to form said channel.

Preferably the first component is a former in the shape of a tapered cone.

Preferably the second component is a conveyor belt.

Preferably the first component is a former in the shape of a tapered cone having a longitudinal opening and wherein the second component is a conveyor belt operably connectable with said opening.

Preferably said starting material is carried by said conveyor belt.

Preferably said starting material is carried on paper by said conveyor belt.

Preferably said paper provides a covering for said rod.

Preferably at least one edge of said paper carries an adhesive.

Preferably said adhesive is a hot melt adhesive.

Preferably said support material enters the rod forming means via a port located in the former. In a preferred aspect, the position of the port is adjustable. Preferably, the port is adjustable in a direction perpendicular to the longitudinal axis of the channel.

Preferably said port is provided by a tube extending into said former. The tube may be in the form of a hollow needle.

Preferably at least part of said tube extends along the inner space of said former whereby the end of said tube inside said former defines said port.

Thus, in a preferred aspect, the positioning of the tube is adjustable. Preferably, the tube is adjustable in a direction perpendicular to the longitudinal axis of the channel.

Preferably said rod forming means comprises a garniture.

Preferably said rod forming means comprises a garniture defining said channel.

Preferably the initial coating or impregnation of said portion of said solid support with an additive occurs whilst the solid support is located in the garniture. With this preferred aspect, initial contact of the solid support with the additive occurs in said rod forming means. However, it is to be understood that the solid support may have been pre-treated prior to said initial contact. In the present invention, if said solid support has been pre-treated then the solid support is still contacted with the additive and wherein the initial contact of the solid support with the additive occurs in said rod forming means. The term "pre-treated" includes coating and/or impregnating the support material. Thus, if the support material has been pre-treated with the same type of additive, the initial contact (i.e. the contact of free additive with the support material to be treated (here, further treated) occurs whilst the solid support is located in the garniture.

Preferably the initial contact of the solid support with said starting material occurs whilst the starting material is located in the garniture.

Preferably said starting material is of a planar shape.

Preferably said starting material is cellulosic.

Preferably said starting material is cellulose acetate.

Preferably starting material is tow.

Preferably starting material is bloomed tow.

Preferably at least a portion of the starting material may be modified by coating and/or impregnating thereon and/or admixing therewith an additive. Preferably the additive is a smoke-modifying agent. Preferably the smoke-modifying agent is a flavourant. Preferably said flavourant is menthol.

Preferably said solid support is a thread or a tape.

Preferably said solid support is a thread.

Preferably said solid support is coloured.

Preferably said solid support is coloured and wherein the colour is indicative or suggestive of the smoke modifying agent.

Preferably said solid support is coloured green.

Smoking Article

The invention relates to preparing a rod for use in the preparation of a smoking article. Typically, but not exclusively, the smoking article will contain tobacco. In a highly preferred aspect, the smoking article is a cigarette.

Typically the smoking article comprises a filter rod and a tobacco rod; wherein the filter rod and a tobacco rod are joined together by means of a covering. In a preferred aspect, the present invention provides the filter rod.

The length of the smoking article is advantageously at least 60 mm and should preferably yield not less than six puffs, and more preferably not less than seven puffs when smoked under standard machine smoking conditions. The rod is preferably of uniform cross-sectional shape and dimensions throughout the length of the rod.

Smokable Material

The smoking material is preferably tobacco but may be a non-tobacco smoking material. Examples of non-tobacco smoking materials are dried and cured vegetable material, including fruit materials, and a synthetic smoking material such as may be produced from alginates and an aerosol-generating substance such as ethylene glycol. The smoking material may comprise a blend of tobacco and non-tobacco smoking materials. Where the smoking material comprises tobacco, the tobacco may of any suitable type, or a blend thereof, including air-cured, fire-cured, flue-cured, or sun-cured lamina or stem, and may have been processed using any appropriate process. For example, the tobacco may be cut, shredded, expanded or reconstituted. The smoking material may also include conventional additives, such as ameliorates, colorants, humectants (such as glycerol and propylene glycol), and flavourings (such as sugar, liquorice and cocoa).

Preferably the smokable material comprises or is a tobacco material. Suitably the tobacco material comprises one or more of stem, lamina, and tobacco dust. It is preferred that the tobacco material comprises one or more of the following types: Virginia or flue-cured tobacco, Burley tobacco, Oriental tobacco, reconstituted tobacco.

For some aspects, preferably the smokable material comprises a blend of tobacco material. In some embodiments, preferably the smokable material comprises 10-80% Virginia tobacco, 10-60% Burley tobacco, 0-20% Oriental tobacco, 0-120% reconstituted tobacco and 0-30% expanded tobacco.

The smoking material of smoking articles according to the subject invention preferably comprises or consists of cut tobacco, a proportion of which tobacco may be expanded tobacco. The smoking material may comprise reconstituted tobacco or tobacco substitute material.

Additives for the Smoking Article

Preferably the solid support and/or the smoking material comprises additives. In a highly preferred aspect, at least the solid support is coated with an additive. The coated additive may be applied by impregnation of the support with the desired additive(s).

Examples of additives for use in the preparation of the smoking article of the present invention include (but are not limited to) burn additives, colourants, flavourants, filler materials, binders, aerosol generating means, ash improvers, catalysts, adsorbents, etc. Combinations of additives may be used. Mixtures of inert organic fillers and inorganic fillers may be used.

Flavourant means any substance which releases, produces, neutralizes, masks or alters odours, for example a perfume or deodorant.

Flavouring agents in the smoking article—in particular the smoking material rod—are designed to contribute towards an aerosol which has a unique but very acceptable taste and flavour characteristic to the aerosol smoke. The taste and flavour may not necessarily be designed to imitate tobacco smoke taste and flavour. Flavouring agents may include tobacco extract flavours, menthol, vanillin, toffee, chocolate or cocoa flavours, for example.

The additives—such as the flavourants—may be encapsulated. An example of such is in a film forming vehicle (U.S. Pat. No. 3,006,347). The flavourants may be applied to the wrapper, encapsulated in a tubular ribbon of non-toxic material, such as ethyl cellulose (U.S. Pat. No. 3,162,199), screen printed onto a wrapper as a series of discrete dots of ink containing an additive to be released as the hot burning tip approaches (GB Patent No. 2 007 078), coated onto a thread or tape (GB 2 020 158) and deposited along the length of the tobacco rod or passing as granules of encapsulated flavourant into the garniture of a cigarette making machine (GB Patent No. 2 078 488). A number of flavourant encapsulation techniques also involve encapsulation of a flavourant material within a polysaccharide coating. For example, EP 0 490 559 discloses a filament comprising a core of flavourant material and polysaccharide binder with a coextensive alginate sheath coating. A further encapsulation technique for smoking articles involves microencapsulation of a flavourant material, and incorporation of the microcapsules into a tobacco blend.

Colouring means, such as food grade dyes, for example, or colourants such as liquorice, caramel or malt, or extracts thereof, may be used to darken the colour of the filler material. The presence of vermiculite or other inorganic material, such as iron oxide, may also give a darker colour to the filler material of the smoking article.

Advantageously the smoking material comprises a colourant to darken the material and/or a flavourant to impart a particular flavour. Suitable flavouring or colourant materials include cocoa, liquorice, caramel, chocolate or toffee, for example. Finely ground, granulated or homogenised tobacco may also be used. Industry approved food colourants may also be used, such as E150a (caramel), E151 (brilliant black BN), E153 (vegetable carbon) or E155 (brown HT). Suitable flavourants include menthol and vanillin, for example. Other casing materials may also be suitable. In the alternative, the presence of vermiculite or other inorganic filler materials may give a darker colour to the smoking material.

Preferably the colourant is present from 0-10% and may be as much as 5-7% by weight of the final smoking material. Advantageously the colourant is less than 7% preferably less than 6% and more preferably less than 5% of the final smoking material. Much preferred is use of colourant at less than 4%, less than 3% and less than 2%. Cocoa may suitably be present in a range of 0-5% and liquorice may be present in a range of 0-4%, by weight of the final smoking material. When the colourant is cocoa or liquorice, for example, the minimum amount of cocoa to obtain the desired sheet colour is about 3% and for liquorice is about 2%, by weight of the final smoking material. Similarly, caramel may suitably be present in a range of 0-5%, preferably less than about 2% by weight of the final smoking material, and more preferably about 1.5%. Other suitable colourants include molasses, malt extract, coffee extract, tea resinoids, St. John's Bread, prune extract or tobacco extract. Mixtures of colourants may also be used. Advantageously, if a food dye is utilised in the alternative it is present at 0-5% by weight or less of the final smoking material. The colourant may alternatively be dusted into the sheet after sheet manufacture.

Flavourants may also be added to alter the taste and flavour characteristics of the smoking material.

Flavours that may be used in the present invention include volatile flavours such as menthol, vanillin, peppermint, spearmint, isopinocampheol, isomenthone, mint cooler (obtained from the flavour house IFF), neomenthol, dill seed oil or other similar flavour materials, and mixtures thereof. The invention is suitable for any volatile or semi-volatile flavourant.

The smoking article may comprise a filler material. The filler material may be present in the smokable material and/or in the filter.

Fillers for the filter include organic material(s) and/or inorganic filler material(s). Examples of filler materials for the filter include polymers, preferably having a large surface area, such as branched polymer. Preferred polymers include fibrous cellulose-based material, partially oxidized cellulose, polyaniline, regenerated cellulose, cellulose acetate and the like. Where the filler material is a polymer, suitable examples include linear, branched or dendritic polymers, or combinations or mixtures thereof. The polymer may be a natural polymer, or a derivative thereof, or a synthetic polymer, or mixtures or copolymers thereof. Partially oxidized cellulose is an example of a natural polymer useful as an additional filter material. Other polymers include those based on aniline and derivatives thereof.

The filler material may be an inorganic oxide, preferably a zeolite. Suitable inorganic oxides include, for example, natural zeolite, synthetic zeolite, or mixtures or derivatives thereof. Inorganic oxides may be crystalline, amorphous, or mixtures thereof. Preferred inorganic oxides include oxides of aluminum, silicon, and combinations thereof.

The filler material may be an activated carbon or an activated carbonaceous material.

The filler material may be $CaCO_3$. Calcium carbonate can absorb carboxylic acids.

The filler material may be synthetic polymers such as polyolefins (e.g. polyethylene, polypropylene, etc.), poly(vinyl alcohol), polyesters (e.g. polyethylene terephthalate) and polyamides; natural celluloses derived from wood fibers (e.g. soft wood pulp, hard wood pulp, etc.), seed fibers (cotton such as linter, bombax cotton, kapok, etc.), bast fibers (e.g. hemp, linen, jute, ramie, paper mulberry, paper bush (mitsumata), etc.), and leaf fibers (e.g. Manila hemp, New Zealand flax, etc.); and regenerated celluloses such as viscose rayon, cuprammonium rayon, Fortisan, nitrate rayon, etc. Natural cellulose (especially wood pulp and linter pulp) and regenerated cellulose are particularly preferred.

The filler materials may be one or more of sizing agents e.g. finely divided inorganic substances such as powders of kaolin, talc, diatomaceous earth, titanium dioxide, alumina, quartz, calcium carbonate, barium sulfate, etc.; thermal stabilizers such as salts of the alkali metals and alkaline earth metals; colorants; yield improvers; biodegradation accelerators such as citric acid, tartaric acid, malic acid or the like and/or photodegradation accelerators such as anatase titanium dioxide.

The filler material may be a plasticizer such as triacetin or triethylene glycol diacetate and/or a water soluble adhesive. Suitable water soluble adhesives include for example, natural adhesives (e.g. starch, modified starch, solubilized starch, dextran, gum arabic, sodium alginate, casein, gelatin, etc.); cellulose derivatives (e.g. carboxymethylcellulose, hydroxyethylcellulose, methylcellulose, ethylcellulose, etc.), synthetic resin adhesives (e.g. poly(vinyl alcohol), polyvinylpyrrolidone, poly(vinyl ether), water-soluble acrylic resin, poly (vinyl acetate), vinyl alkyl ether-maleic acid copolymer, poly (alkylene oxide), water-soluble polyester, water-soluble polyamides, and the like.

The filler material may be a combination of two or more filler materials—such as two or more of the above-mentioned materials.

If the filter comprises two or more filler materials, the different materials may be simply mixed together and the mixture applied to a filter space comprised of two sections of particle-filter with an intermediate chamber at the mouth end of a cigarette. Alternatively in another embodiment, the filter may be divided into several compartments which may contain different filter materials or different mixtures of filter materials.

Burn Additives

The smokable material and/or the smokable filler material may comprise a burn additive to enhance the smoking properties of the filler material.

Depending on the properties of the filler the burn additive is either a burn promoter or a burn retardant. Suitable burn additives may be selected from one or more of salts of Group I or II metals such as acetates, citrates and other burn promoters known to the skilled man. Suitable burn retardants include magnesium hydroxide, mono-ammonium phosphate or magnesium chloride, for example.

Ash Improvers

The smokable filler material may also comprise an ash improver, which is advantageously present in the filler in the range of 0-5%. Appropriate ash improvers include one or more of mica, perlite, clays, such as, for example, vermiculite, kaolinites, talcs, saponites, bentonites, as well as ash improvers such as disodium hydrogen orthophosphate, sodium carbonate or diammonium phosphate, for example.

Inorganic Filler Material

The smokable filler material may comprise an inorganic filler. Advantageously the inorganic filler material is one or more of perlite, alumina, diatomaceous earth, calcium carbonate (chalk), vermiculite, magnesium oxide, magnesium sulphate, zinc oxide, calcium sulphate (gypsum), ferric oxide, pumice, titanium dioxide, calcium aluminate or other insoluble aluminates, or other inorganic filler materials. The density range of the materials is suitably in the range of 0.1-5.7 $g/cm^3$. Advantageously, the inorganic filler material has a density that is less than 3 $g/cm^3$, and preferably less than 2.5 $g/cm^3$, more preferably less than 2.0 $g/cm^3$ and even more preferably less than 1.5 $g/cm^3$. An inorganic filler having a density of less than 1 $g/cm^3$ is desirable. A lower density inorganic filler reduces the density of the product, thus improving the ash characteristics.

Organic Filler Material

The smokable filler material may comprise an organic filler. Advantageously the organic filler material is inert or relatively inert when alone i.e. will not readily maintain burning, but in a mixture may become more combustible, i.e. will maintain burning. Suitable organic fillers include insoluble alginates, such as calcium or magnesium alginate, calcium pectinate or alginic acid, as well as non-modified cellulose, such as treated or non-treated wood pulp or alpha cellulose, for example.

Aerosol Generating Means

The smoking article may comprise aerosol generating means.

Preferably the aerosol generating means is present in the range of 5-20%, more preferably is less than 15%, is even more preferably greater than 7% and even more preferably is greater than 10%. Preferably the aerosol generating means is less than 13%. Most preferably the aerosol generating means is between 11% and 13%, and may advantageously be about 11.25% or 12.5%, by weight of the smoking material. Suitably the amount of aerosol generating means is selected in combination with the amount of tobacco material to be present in the blend comprising the smokable filler material of a smoking article. For example, in a blend comprising a high proportion of non-tobacco material with a low proportion of tobacco material, the smoking material may require a lower loading level of aerosol generating means therein. Alternatively in a blend comprising a low proportion of non-tobacco material with a high proportion of tobacco material, the smoking material may require a higher loading level of aerosol generating means therein.

Aerosol forming means are known to those skilled in the art. Suitable aerosol generating means include aerosol forming means selected from polyhydric alcohols, such as glycerol, propylene glycol and triethylene glycol; esters, such as triethyl citrate or triacetin, high boiling point hydrocarbons, or non-polyols, such as glycols, sorbitol or lactic acid, for example. A combination of aerosol generating means may be used. An additional function of the aerosol generating means is the plasticising of the sheet material. Suitable additional plasticizers include water.

The aerosol generating source preferably comprises aerosol forming means, such as glycerol and/or other aerosol forming compounds illustrated in our co-pending PCT Application No. WO 96/07336. These include polyhydric alcohols, propylene glycol and triethylene glycol, esters such as triethyl citrate, triacetin or triethylene glycol diacetate (TEGDA), or high boiling point hydrocarbons.

The aerosol transfer efficiency is measured as the percentage aerosol in the smoke divided by the percentage aerosol in the smokable filler material.

Vapour Phase Reducers

The smoking article of the present invention may have vapour phase reducer(s). By way of example, the smoking article may comprise filter elements which contain means to reduce vapour phase constituents of smoke from the smoking articles.

The use of carbon or activated carbon in tobacco smoke filter elements to reduce vapour phase constituents of smoke has been known for some while. Commonly, carbon has been utilised either in a dual filter arrangement, the carbon granules being sprinkled onto sticky cellulose acetate tow, which tow is gathered in conventional manner and cut into double unit lengths. The double unit lengths of carbon containing acetate are then interdigitated with plain cellulose acetate filter elements having double unit lengths. The interdigitated assemblies are wrapped in plugwrap and then cut in the mid-point of both the carbon-containing filter element double unit length and the plain cellulose acetate double unit length to provide wrapped filter elements having a carbon-containing section adjacent a non carbon-containing section. This type of filter is known as an active acetate of AA filter.

In the alternative, carbon has been utilised in a triple filter arrangement either with the carbon being incorporated in the cellulose acetate tow, as described above, and in UK Patent Specification No. 1,087,909, or with the carbon being freely held in a cavity between two plugs of tobacco smoke filtration material, such as cellulose acetate, and described in U.S. Pat. No. 4,185,645. Another alternative and commercially produced carbon filter is the ACT (Active Carbon Thread) Filter made by Filtrona UK, where the carbon in the centre section is adhered to a cotton thread and then surrounded by cellulose acetate. The carbon thread section offers the path of least resistance and the majority of the smoke passes through the carbon centre.

Fibriform Materials

The smoking article of the present invention may comprise fibriform material—such as in the smoking material rod.

In this respect, fibriform smoke-modifying material may be fed longitudinally thereof to a rod making machine, the longitudinal feed path in said machine being in a travel direction of the smoking material deposition run of the suction band of said machine, said feed path of said fibriform smoke-modifying material being caused to ascend towards said deposition run under the influence of the suction force towards said run until at a predetermined distance along said deposition run said fibriform material becomes supported and is subsequently maintained at a predetermined distance from said run by particulate smoking material deposited on said run, thereafter further said smoking material being deposited on said run.

In another respect, fibriform smoke-modifying material may be fed longitudinally thereof to a rod making machine, the feed path in said machine extending in the travel direction of the smoking material deposition run of the suction band of said machine, said fibriform material being constrained by guide means in said machine to follow said feed path spaced from said run of said suction band against the suction force towards said run until at a predetermined distance along said deposition run said fibriform material becomes supported and is subsequently maintained at a predetermined distance from said run by particulate smoking material deposited on said run, thereafter further said smoking material being deposited on said run.

The fibriform smoke-modifying material may suitably take the form of a single, continuous, fibriform element.

Alternatively, the fibriform smoke-modifying material could be fed to and into contact with the particulate smoking material in the form of a sequence of discrete fibriform elements. In the latter case each element, in the feed path of the elements, may be at each end thereof in contact with the respective ends of the next adjacent elements of the sequence thereof, or may be spaced therefrom.

In that particulate smoking material is deposited on the deposition run of the suction band both before and after the fibriform smoke-modifying material becomes supported at, or substantially at, the said predetermined distance from the run by smoking material on the run, in the carpet of smoking material as finally formed at the downstream end of the run the element(s) is disposed other than at the upper or lower boundary of the carpet. The position of the element(s) relatively of the upper and lower boundaries is determined in accordance with the location along the deposition run of the suction band at which the element(s) becomes supported by the smoking material deposited on said run. Suitably, the said location is selected to be in a mid zone of that portion of the deposition run which extends from the location at which smoking material is first deposited on the deposition run to the downstream location at which the carpet of smoking material is finally formed, i.e. the location at which deposition is terminated. Thus, for example, the said location may be situate between about 25% and about 60% of the length of the said portion of the deposition run as taken from the location at which smoking material is first deposited on the run, and preferably between about 25% and about 40% of that length.

Suitably too, if the fibriform smoke-modifying material takes the form of a single only, continuous fibriform element, the feed path of the fibriform element in the making machine is aligned, or substantially aligned, with the plan view longitudinal centre line of the carpet on the deposition run of the suction band; that is to say, the element is, throughout the feed path thereof in the making machine, equi-distant, or substantially equi-distant, the suction band guide rails of the machine. As will be readily apparent to those of ordinary skill in the art, if two, say, continuous fibriform elements are fed to the making machine, the respective feed paths thereof are in the proximity of the said longitudinal centre line of the carpet. By virtue of the said location being appropriately positioned in a mid zone of the said portion of the deposition run, and, in the case of a single element, the element being aligned with the aforesaid plan view centre line of the carpet, it may be readily arranged that the element extends axially of the subsequently formed smoking material rod.

Solid Support

The solid support provides a suitable matrix for supporting agents—such as chemicals.

Preferably the agent is one or more smoke-modifying agent(s).

The support may be made from any suitable material—such as natural or un-natural fibres; or combinations thereof.

Preferably the shape of the support is substantially similar along its longitudinal axis.

The support may be coated with additional agents that facilitate the coating of the smoke-modifying agent(s) thereto—or ease the impregnation thereof.

The support may be in the form of a thread of a tape.

In a preferred aspect, the solid support is coloured. In this respect, consumer preference is to see the solid support in the rods—if the rods are filters.

In a preferred aspect, the colour of the solid support is indicative or suggestive of the smoke modifying agent. For example, if the agent is menthol, then preferably the colour is green. Other examples could be yellow for vanillin, dark green for mint, brown for cocoa etc.

Positioning of Solid Support

The solid support extends longitudinally within said rod.

In a highly preferred aspect, the solid support is positioned along the central longitudinal axis of the rod. With the method of the present invention, manufacturers can achieve this with a higher degree of accuracy and reliability than before.

Preferably, at least one end of the solid material is at one end of the rod. More preferably, the ends of the solid material are at opposite ends of the rod. In other words, all of the solid support extends from the first end of said rod to the second end of said rod. Alternatively expressed, the lengths of the solid material and the rod are the same.

Numbers of Solid Supports

Whilst it is highly preferred that there is just one solid support in the rod, the present invention does allow for two or more solid supports being present in the rod.

In this respect, the solid supports may be of different colours and/or carry the same or different additives.

If there is a plurality of solid supports then it is feasible that one or more of the plurality of the solid supports may not be coated with additives—as they may serve (for example—a decorative effect.

If there is a plurality of supports then preferably each of the solid supports extends from the first end to the second end of the rod. Preferably, each of the solid supports extend longitudinally within the rod. Preferably, at least one of the solid supports is positioned along the central longitudinal axis of the rod.

Smoke-Modifying Agent

Preferably the additive is a smoke modifying agent.

The agent may be a single agent or may be a mixture of agents.

Preferably the smoke modifying agent is at least one flavourant.

Preferably the flavourant is used in a substantially pure form for coating the support material.

In a preferred embodiment the additive for the support material is menthol.

It is to be noted that the tobacco for the smoking article may also be coated with smoke-modifying agents—of the type just described.

The smoke-modifying agent may be any suitable agent. Examples include agents that affect the taste or aroma to the smoke. The agents may suppress or enhance one or more taste or aroma component(s). The agents may themselves impart taste or aroma characteristics. Specific examples include agents such as flavourants—such as menthol, liquorice, tobacco (extract) flavours, mint, vanillin, clove, cocoa, toffee, chocolate, caramel, molasses, malt extract, coffee extract, tea resinoids, prune extract, peppermint, spearmint, isopinocampheol, isomenthone, mint cooler (obtained from the flavour house IFF), neomenthol, dill seed oil etc.

Colourant

The additive for the support material or the starter material may be a colourant. Industry approved food colourants may also be used, such as E150a (caramel), E151 (brilliant black BN), E153 (vegetable carbon) or E155 (brown HT). Other examples of colourants are listed herein.

Starting Material

The starting material may be any suitable starting material. In particular, the starting material is cellulosic material suitable for forming a filter—in particular a cigarette filter. Thus, in a preferred aspect, the starting material is cellulose acetate and is tow.

For some embodiments, at least a portion of the starting material may be modified by coating and/or impregnating thereon an additive—such as those mentioned above.

In a preferred aspect, the starting material provides for a number, preferably most, more preferably all of the components of the filter (such as the filter components as herein described) except for the support material. The starting material may be loaded with one or more desired filter components prior to contact with the support material. Preferably, the tow is pre-loaded with one or more desired filter components and wherein optionally one or more additional desired filter components are further loaded onto the starting material prior to contact with the support material.

In a highly preferred aspect, the starting material is tow, more preferably bloomed tow.

Filter

In a preferred aspect, the starting material is suitable for forming a filter, in particular a filter for a cigarette. The filter itself is sometimes referred to as the filter element.

Advantageously the filter may be a conventional fibrous cellulose acetate, polypropylene or polyethylene material or gathered paper material. Multiple filter elements may also be utilised. Filter elements having particular pressure drop characteristics, such as the filter sold by Filtrona and known as The Ratio Filter, may also be utilised. Disposed upon or within the material of the filter element may be further smoke modifying agents—such as flavouring agents as described herein, which are released or eluted from the filter element by the aerosol generated by the heated or burnt aerosol generation means.

For some embodiments, the filter contains particulate material, such as granular carbon, which may suitably be activated carbon. The activated carbon may be activated coconut carbon. The filter containing particulate material may be a dual filter comprising, for example, a cellulose acetate mouth section and a dalmatian rod at the tobacco end of the filter. A paper section may also form part of a multiple filter. Alternatively, the filter may be the filter manufactured in accordance with the structural design of the filter known as the Active Patch filter (manufactured by Filtrona International) as described in UK Patent Specification No. 2249936. In a yet further alternative, the filter element may be cavity filter comprising two end sections with a central cavity containing granular material.

The term 'carbon' as used herein can be taken to cover a material which is substantially solely carbon and any carbon precursors, such as carbonaceous material.

As used herein the term carbonaceous includes material which has been pyrolyzed, which material preferably contains carbon, although some incomplete combustion products may still be present. Ready pyrolyzed coconut fibre may, for example, be the carbonaceous material from which carbon is derived.

The filter may alternatively be a selective reduction filter as described in co-pending U.S. Provisional Patent Application Ser. Nos. 60/309,388 and 60/309,435 both filed on 1st Aug. 2001.

The filter may comprise a mouth end located filter plug. The mouth end located filter plug may be made from a variety of material, for example, cellulose acetate tow, cellulose, paper, cotton, polypropylene web, polypropylene tow, polyester web, polyester tow or combinations thereof.

In addition, the pressure drop and/or mechanical filtration efficiency of the filter plug sections can be selected to achieve the desired smoking mechanics and filtration characteristics as may be required with the specific product design desired.

A further filter construction that may be useful in the present invention is that described in our co-pending International Patent Application No. PCT/GB02/005603. The grooved arrangement of the filter described therein provides for ventilating air to enter grooves extending towards the tobacco end and then be re-directed towards the mouth end. The result is a decrease in the CO/tar ratio. In combination with particulate additives that selectively reduce vapour phases a significant reduction in vapour phase constituents can be achieved.

The filter may comprise a general adsorbent. Advantageously the general adsorbent is selected from a group of relatively high surface area materials capable of adsorbing smoke constituents without a high degree of specificity. Suitable general adsorbents can be selected from the group consisting of activated charcoal, activated coconut carbon, activated coal-based carbon or charcoal, zeolite, silica gel, meerschaum, aluminium oxide (activated or not), carbonaceous resin or combinations thereof. An example of a suitable coal-based charcoal is one made from semi-anthracite coal with a density about 50% greater than coconut-based charcoal (available from Calgen Carbon, Pittsburgh, Pa., WA). An example of a suitable carbonaceous resin is one derived from the pyrolysis of sulphonated styrene-divinyl benzene, such as Ambersorb 572 or Ambersorb 563 (available from Rohm and Haas). To enhance the efficiency of the general adsorbent metal oxides or other metal based complexes may optionally be included in or impregnated on the general adsorbent section.

In a highly preferred aspect, a first portion of the filter comprises an adsorbent material. Preferably the adsorbent material is a general adsorbent. The general adsorbent material is preferably selected from a group of relatively high surface area materials, such as activated charcoal, which are capable of adsorbing a range of chemical compounds without a high degree of specificity. In this embodiment, preferably the general adsorbent is a carbonaceous material such as, for example, activated charcoal, activated coconut carbon, activated coal-based carbon or synthetically derived carbon. Suitably the carbonaceous material may be in the form of a thread, particles/granules, cloth, paper or a reconstituted carbon-containing sheet, or any other suitable form whatsoever. The general adsorbent may alternatively be a non-carbonaceous material such as, for example, zeolite, silica, meerschaum, aluminium oxide or combinations thereof. Other suitable adsorbent materials will be well known in the art.

A portion of the smoke filter may comprise a catalyst. Advantageously the catalyst facilitates the conversion of carbon monoxide (CO) to carbon dioxide ($CO_2$) in the vapour phase of the smoke. It is much by preference that the catalyst is highly selective for carbon monoxide. Preferably the catalyst may be one of the group consisting of transition metal oxides, silica, alumina, zeolites, impregnated carbon, for example, carbon impregnated with metals.

The filter may comprise a selective adsorbent. The selective adsorbent material is preferably a material having an affinity for a predetermined class of chemical compounds. The selective adsorbent material is chosen based on the specific smoke constituents targeted for removal from the smoke. Preferably the selective adsorbent may be selected from the group consisting of an ion-exchange resin, such as Duolite™ or amberlite for example, zeolite, silica, or any other suitable selective adsorbent known to the person skilled in the art. Although zeolite and silica may be either general or selective adsorbents it will be apparent to the skilled artisan that these compounds can be physically and/or chemically modified to form a selective adsorbent. For example, a synthetic zeolite containing transition metal ions may be capable of oxidation of smoke constituents such as carbon monoxide, ammonia and/or hydrocarbons, for example.

Preferably the first portion of the filter, and the third portion (if present), may be a cavity containing an adsorbent and/or catalyst or, alternatively, may comprise a conventional smoke filtration material having an adsorbent and/or catalyst dispersed therein.

Advantageously the adsorbent is capable of retaining at least a portion of the vapour phase of smoke.

For some embodiments, preferably the second portion of the smoke filter of the present invention comprises a conventional smoke filtration material. Suitable conventional materials include cellulose acetate, paper, polypropylene and other materials that will be well known to persons skilled in the art and capable of retaining at least a portion of the particulate phase of smoke. The first and second portions of the smoke filter of the present invention may be arranged in co-axial alignment.

The first portion forms the inner core and the second portion may form the outer annulus of a core-annulus arrangement of the filter of the present invention. Alternatively the second portion of the filter may form the core and the first portion may form the outer annulus of such an arrangement.

Wrapping

Suitably the filter of the present invention may be wrapped in a plug wrap. In addition, the filter may be attached to a rod of smoking material—such as a tobacco rod—by means of a tipping wrapper. It is much by preference that the tipping wrapper is ventilated by means of ventilation holes therein. Advantageously the tipping wrapper is a paper.

In a dual or triple filter arrangement the pressure drop of the filtration material plugs may be varied. As used herein the terms dual filter and triple filter mean filter elements comprising two or three distinct or discrete sections.

The ventilation means may suitably comprise perforation holes in the tipping wrapper used to inter-attach the filter element and the rod of wrapped tobacco filler material.

Alternatively the ventilation means may be provided by the use of a porous tipping wrapper used in conjunction with a perforated plugwrap. The porous tipping wrapper may be porous over its full extent or over only a localised extent, which extent is in registration with the underlying perforated plugwrap.

In a further alternative the ventilation means may be provided at or close to the end of the rod of wrapped tobacco filler material. The ventilation means may be provided in the tipping wrapper or in the cigarette paper wrapper enwrapping the tobacco filler material.

In a yet further alternative, the ventilation means may be provided at the location of a member situated between the filter element and the rod of wrapped tobacco filler material.

The ventilation means is preferably located at an upstream end of the filter element or to the upstream of the filter element. The ventilation means may be provided such that air passes through the region comprising means to reduce the vapour phase constituents of tobacco smoke to guide the smoke away from the said region, whilst still allowing diffusion of the vapour phase constituents into the said region.

The wrapper of the smoking article may alternatively or in addition be a non-paper wrapper, such as the wrappers described in International Patent Applications, Publications Nos. WO 96/07336 and WO 01/41590. Such wrappers assist in the reduction of sidestream smoke components, but still provide a smoking article which has burning and ashing characteristics similar to conventional products, i.e. the wrappers allow the smoking article to burn down and ash in a similar way to conventional products.

The wrapper may suitably be a paper wrapper or a substantially non-combustible wrapper, such as that described in WO 96/07336. The subject matter of that application as it relates to the substantially non-combustible wrapper is incorporated herein by reference. The wrapper thereof advantageously contains at least 65% inorganic particulate filler material, such as those inorganic materials described above.

A conventional cellulose pulp paper wrapper may have a permeability in the range 2-300 CU and preferably less than 100 CU. Such a wrapper may also be a low total filler paper such as disclosed in European Patent Application No. 0 404 580 and comprising less than 14% magnesium oxide or hydroxide, for example.

Burn Additives

The wrapper enwrapping the smoking article may comprise a burn additive, such as sodium and/or potassium citrate, for example. Other suitable burn additives, such as sodium or potassium salts, such as acetate and tartrate; mono-ammonium phosphate, and di-sodium hydrogen phosphate, for example, will be known to the skilled person.

Advantageously the burn additive is present in the range of 0.5-2.5% by weight of the wrapper. The wrapper may also have a basis weight in the range of 20-40 g/m$^2$.

Binders

The smoking article may comprise one or more binders. The binders may be present in or on the filter and/or the wrappings/coverings/casings and/or the tobacco material.

For some embodiments the binder may be a mixture of alginate and non-alginate binders. With this embodiment, preferably the binder comprises at least 50% alginate, preferably at least 60% alginate and even more preferably at least 70% alginate. The amount of combined binder required may suitably decrease when a non-alginate binder is utilised. The amount of alginate in a binder combination advantageously increases as the amount of combined binder decreases. Suitable alginic binders include soluble alginates, such as ammonium alginate, sodium alginate, sodium calcium alginate, calcium ammonium alginate, potassium alginate, magnesium alginate, triethanol-amine alginate and propylene glycol alginate. Other organic binders such as cellulosic binders, gums or gels can also be used in combination with alginic binders. Suitable cellulosic binders include cellulose and cellulose derivatives, such as sodium carboxymethylcellulose, methyl cellulose, hydroxypropyl cellulose, hydroxyethyl cellulose ethers. Suitable gums include gum arabic, gum ghatti, gum tragacanth, Karaya, locust bean, acacia, guar, quince seed or xanthan gums. Suitable gels include agar, agarose, carrageenans, furoidan and furcellaran. Starches can also be used as organic binders. Other suitable gums can be selected by reference to handbooks, such as Industrial Gums, E. Whistler (Academic Press).

The binder may be an organic binder, such as an alginate, a gum, a cellulose (modified or natural), a pectin or pectinaceous binder, or the Group I or II metal salts of these binders, such as sodium carboxymethylcellulose or sodium alginate. Preferred binders are alginic binders which include soluble alginates such as ammonium alginate, sodium alginate, sodium calcium alginate, calcium ammonium alginate, potassium alginate, triethanol-amine alginate and propylene glycol alginate. Alginic binders provide the preferred smoking mechanics and taste and flavour properties for the smokable filler according to the invention.

Cellulosic binders include, for example, cellulose derivatives, such as sodium carboxymethylcellulose, methyl cellulose, hydroxypropylcellulose, hydroxyethyl cellulose or cellulose ethers. These binders are preferred for extrusion purposes.

Other organic binders include gums such as gum arabic, gum ghatti, gum tragacanth, Karaya, locust bean, acacia, guar, quince seed or xanthan gum, or gels such as agar, agarose, carrageenans, fucoidan and furcellaran. Pectins and pectinaceous materials can also be used as binders. Starches can also be used as organic binders. Other suitable gums can be selected by reference to handbooks, such as Industrial Gums, Ed. Whistler (Academic Press). Inorganic non-combustible binders, such as some cements, for example. Portland cement, may also be used.

Combinations of the above binders may also be used.

EXAMPLES

The present invention will now be described purely by way of example only. Reference will be made to the following Figures.

Figure 1B:
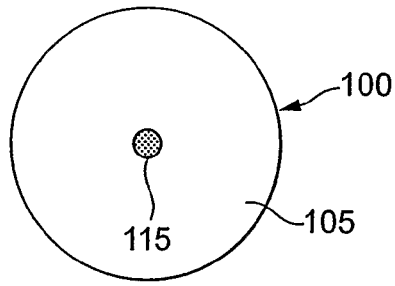

FIG. 1—which shows views of a rod according to the present invention.

Figure 2:
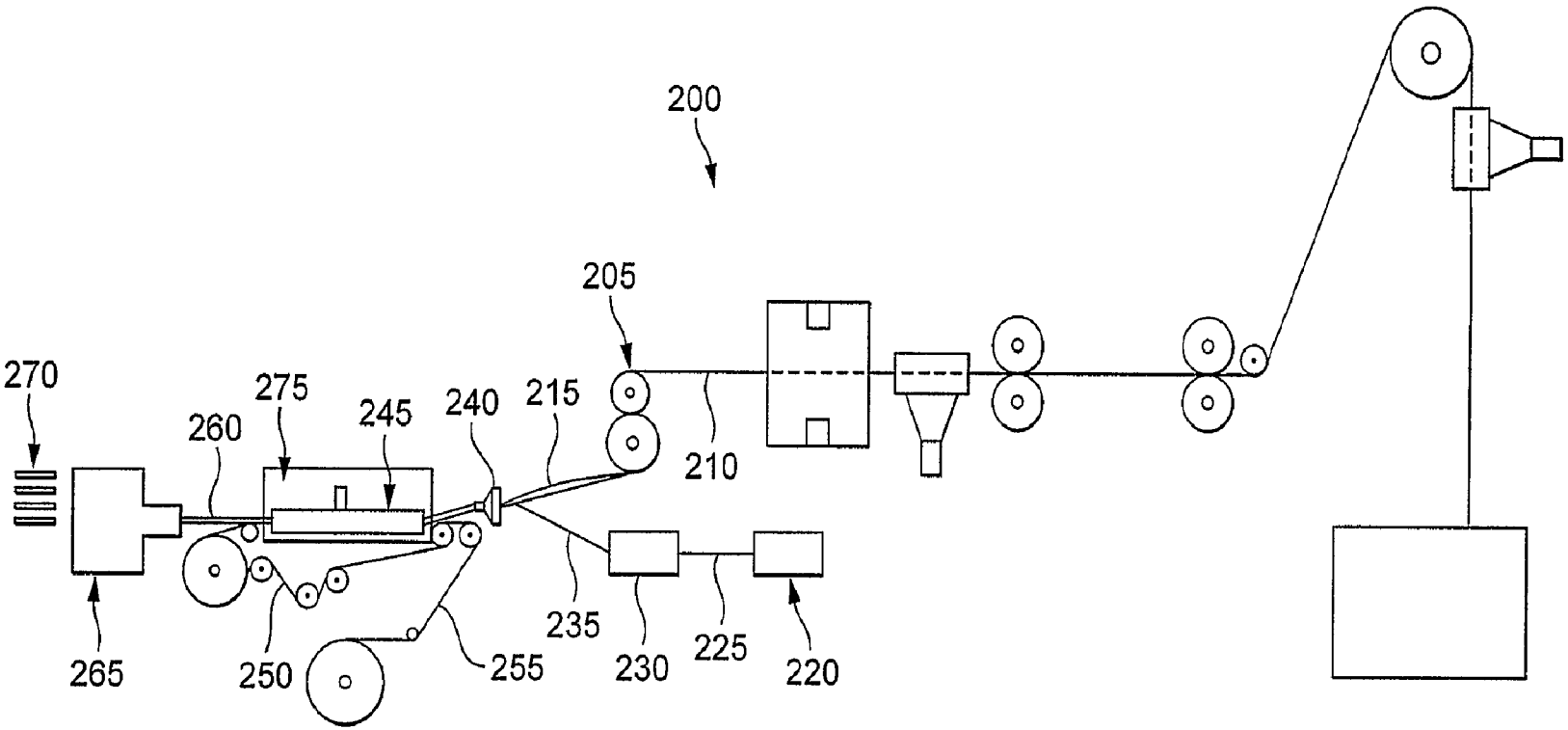
FIG. 2 PRIOR ART

FIG. 2—which is a Figure taken from—and illustrating the apparatus of—U.S. Pat. No. 4,281,671.

Figure 3:
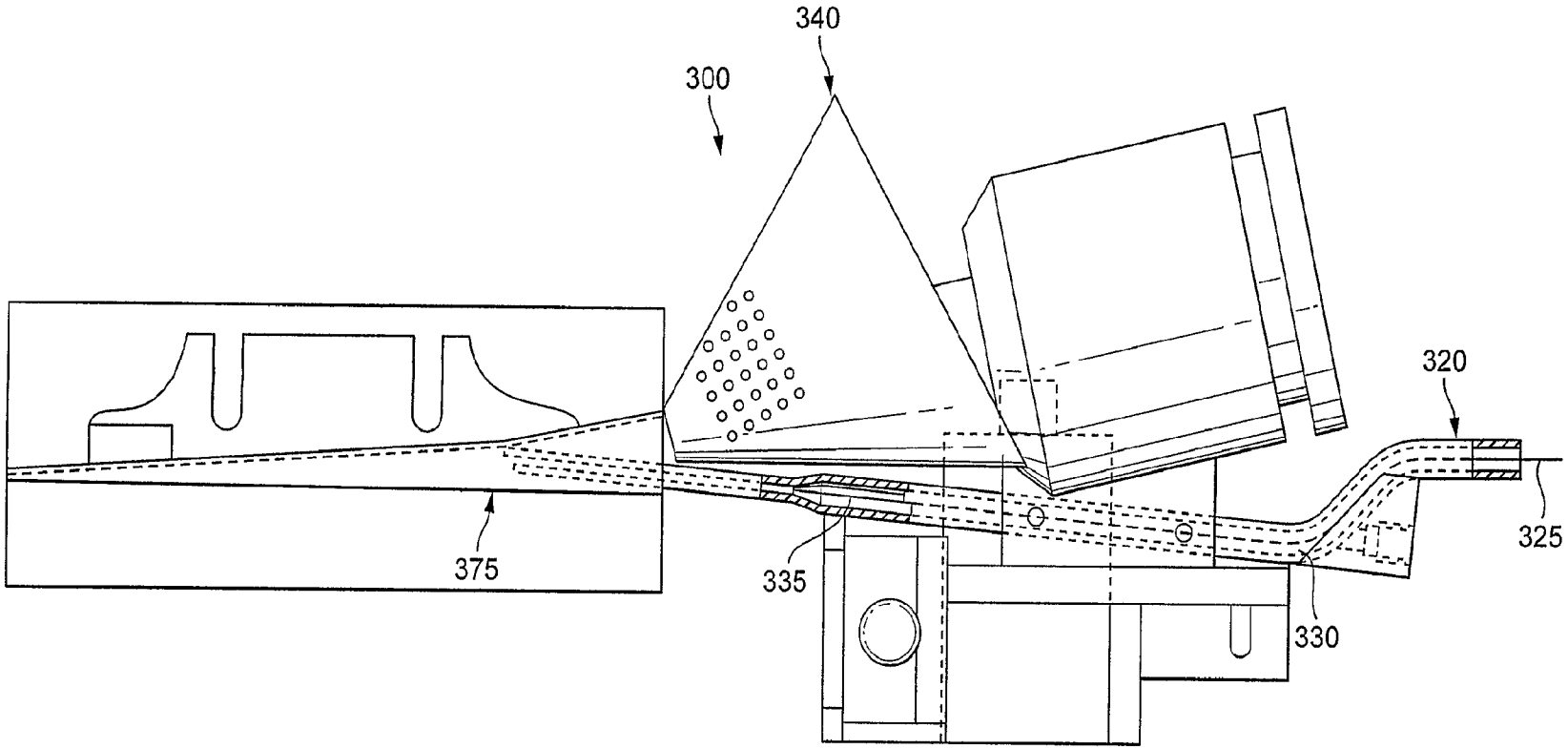
FIG. 3 PRIOR ART

FIG. 3—which is a Figure taken from—and illustrating the apparatus of—US 2005/0255978.

Figure 4:
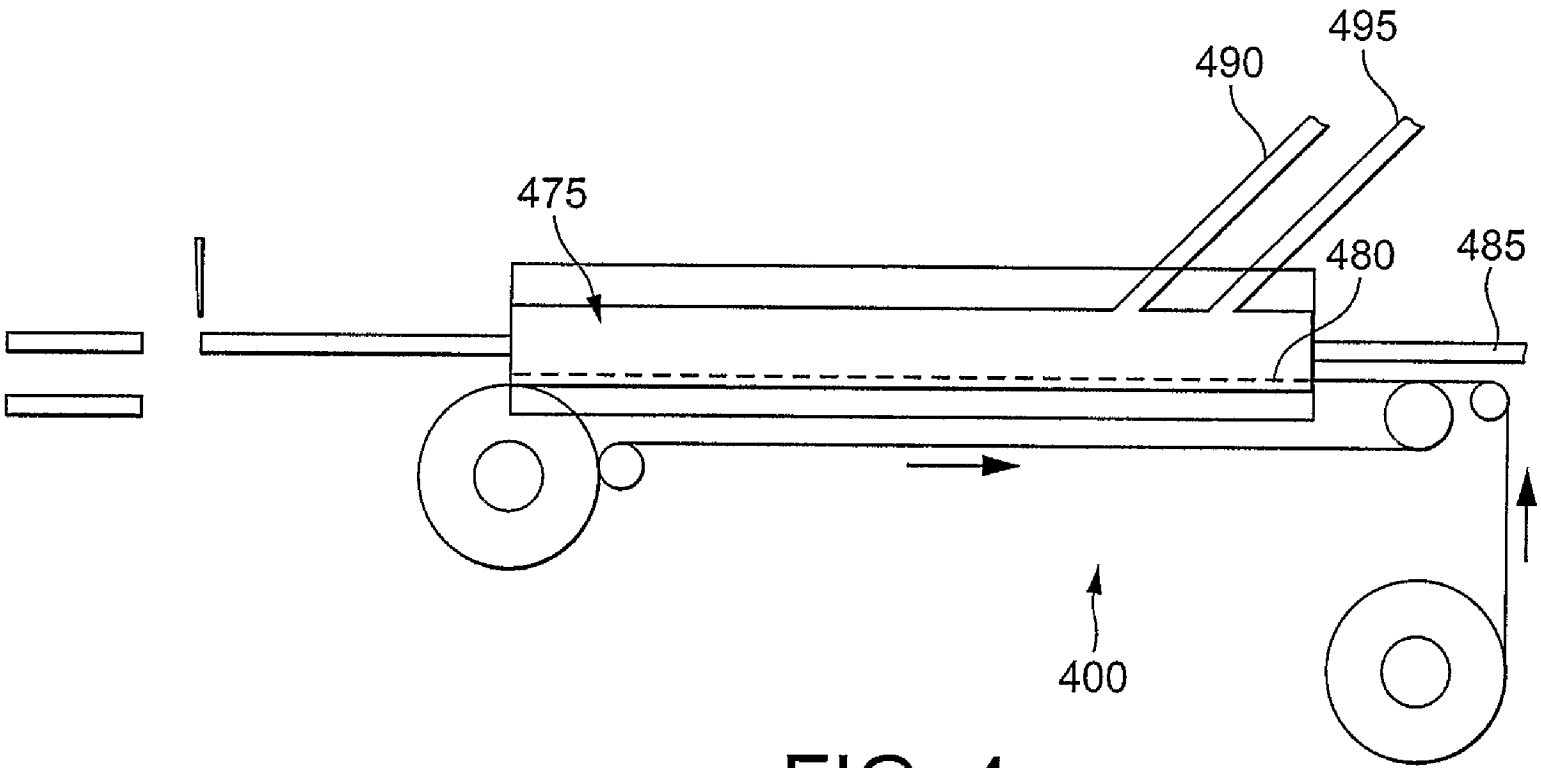

FIG. 4—which shows an apparatus according to the present invention.

Figure 5:
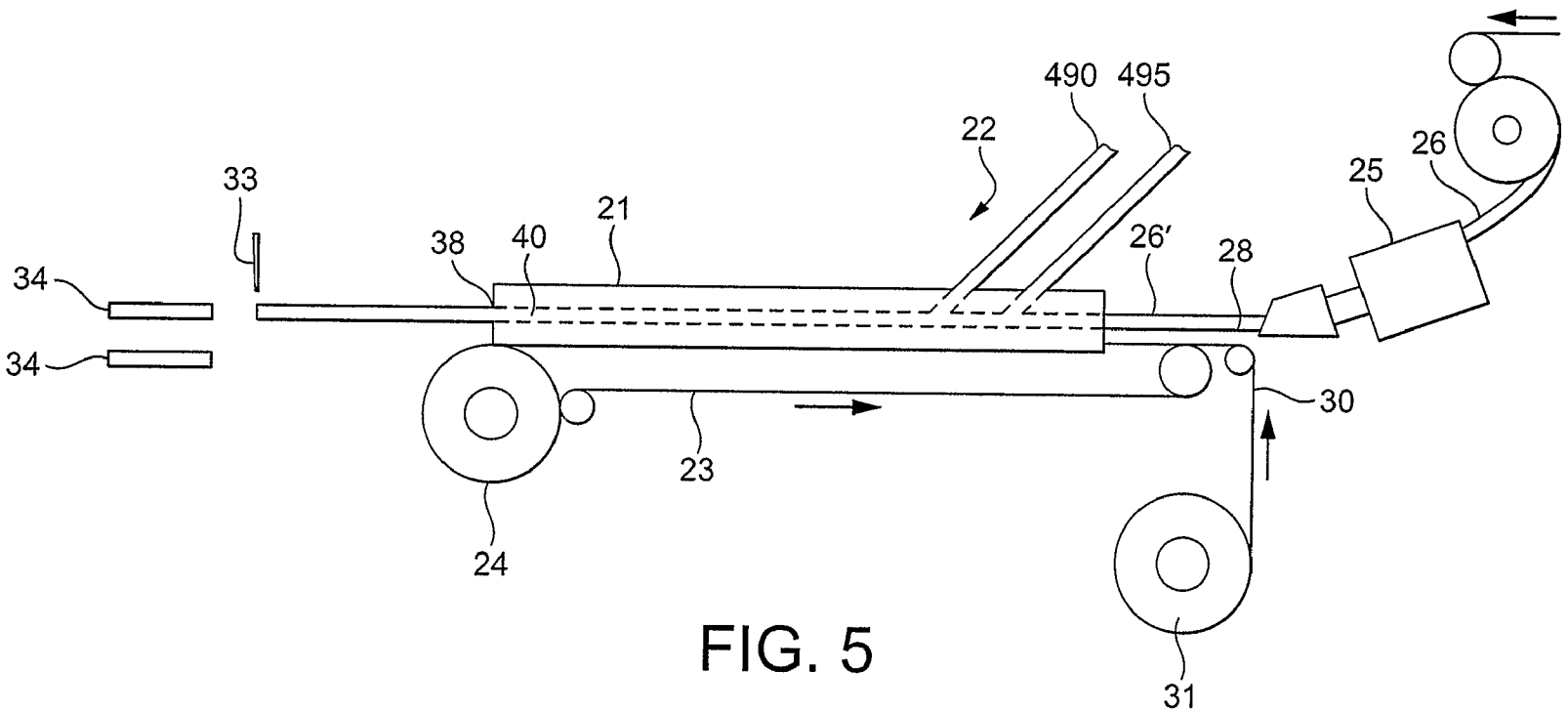

FIG. 5—which shows the apparatus according to the present invention in use.

Figure 6:
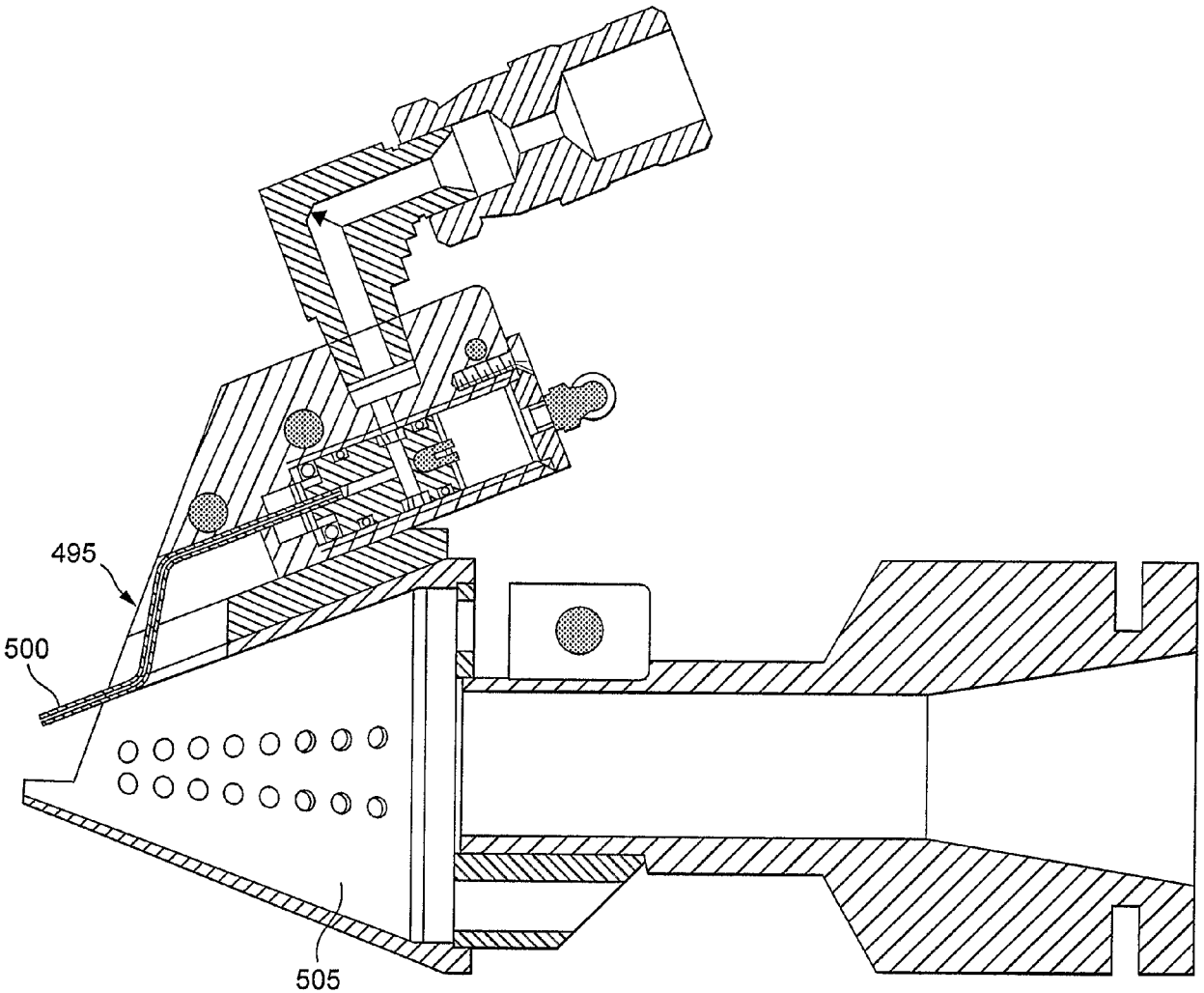

FIG. 6—which shows an alternative embodiment of the present invention.

Figure 7:
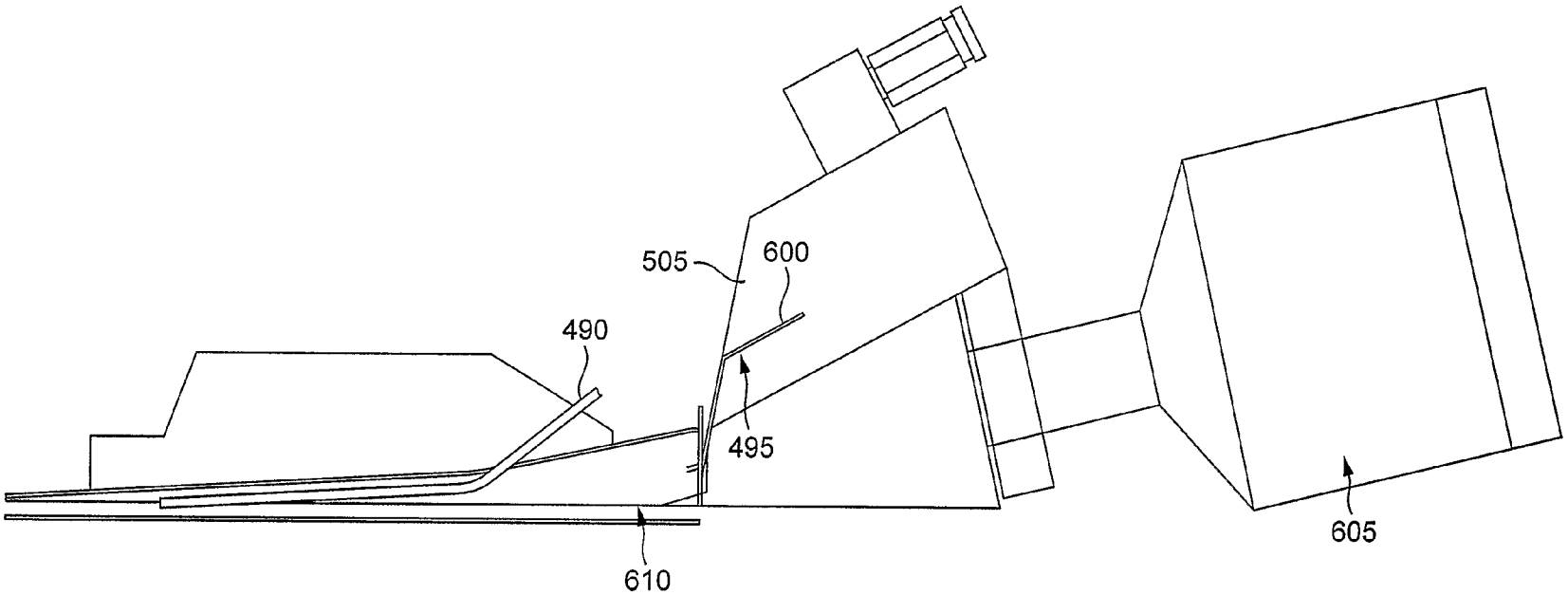

FIG. 7—which shows an alternative embodiment of the present invention.

Figure 8:
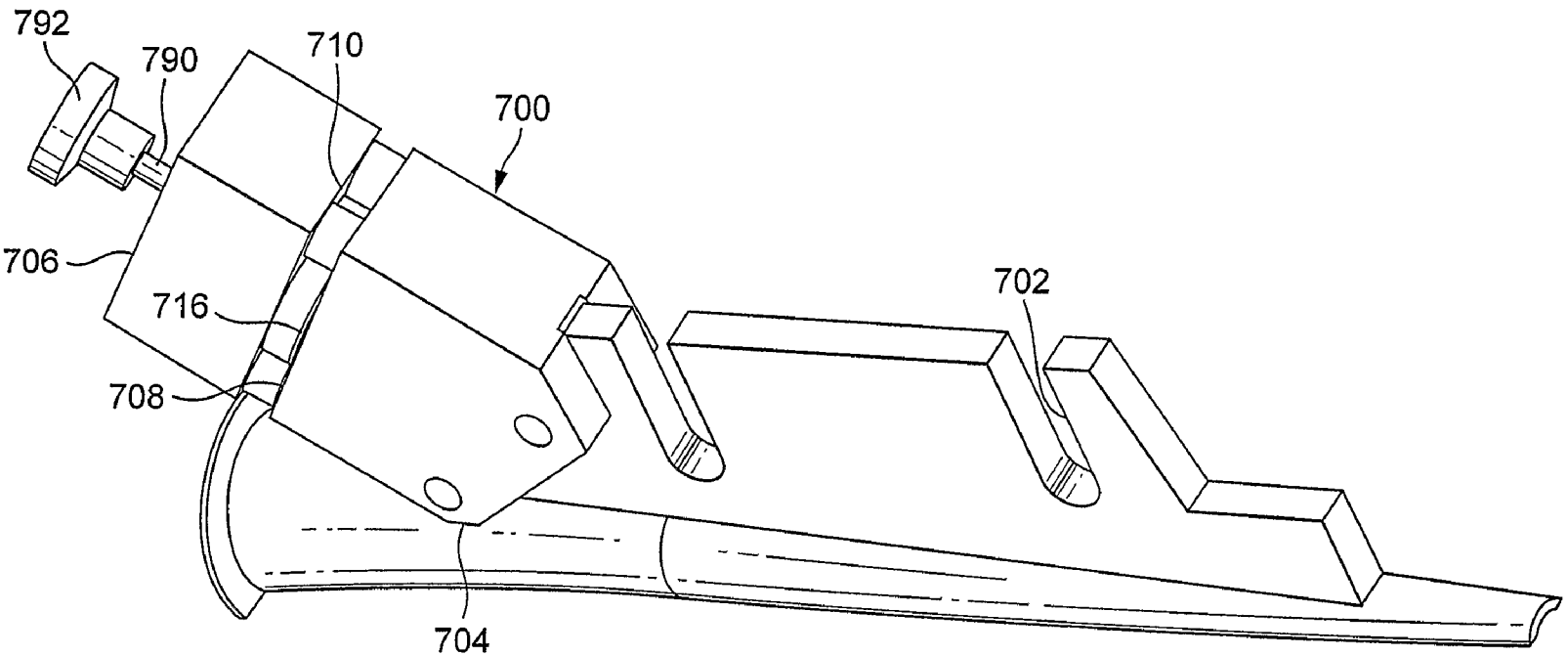

FIG. 8—which shows an alternative embodiment of the present invention.

Figure 9:
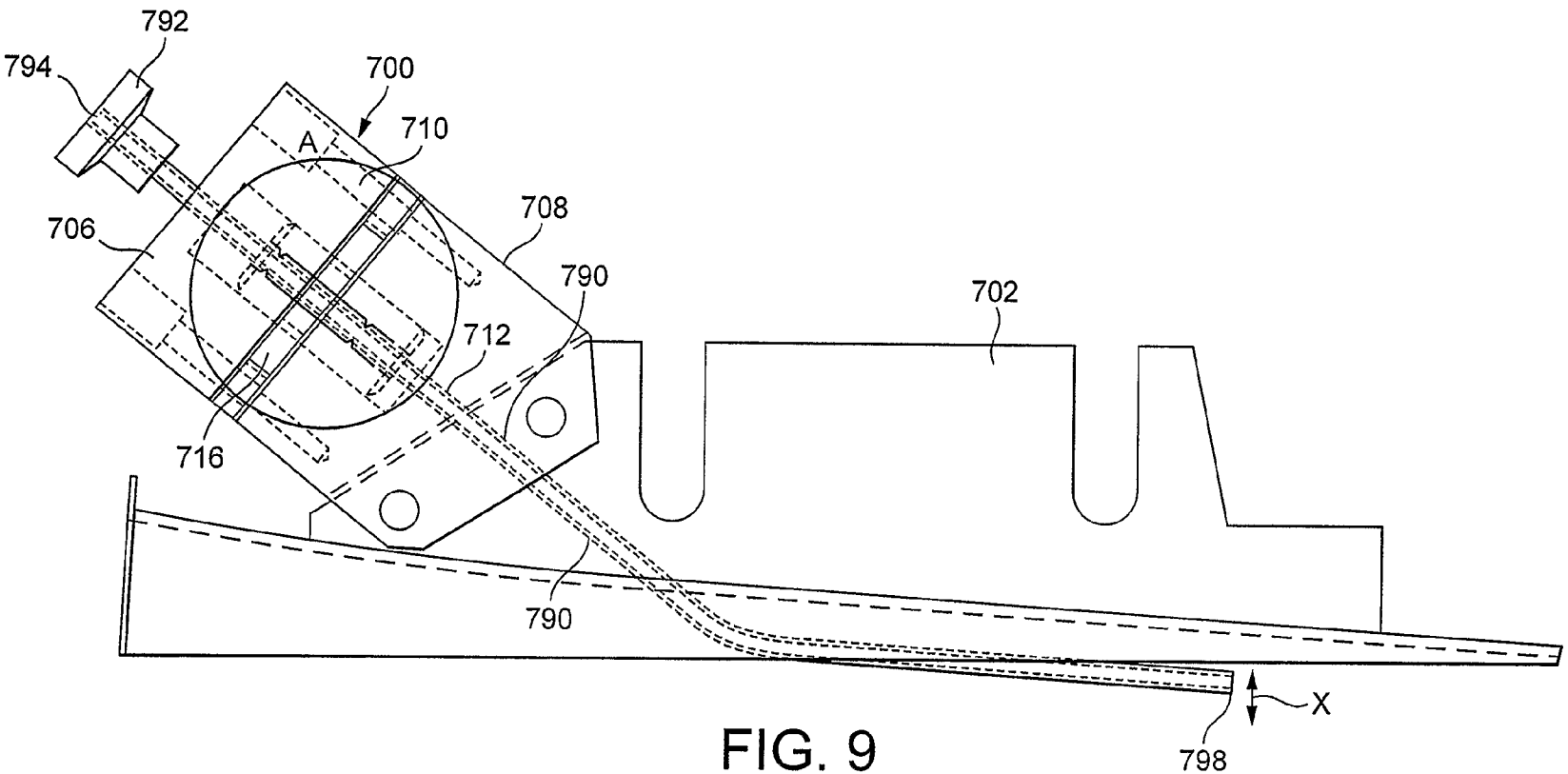

FIG. 9—which shows a diagrammatic cross sectional view of the embodiment of FIG. 8.

Figure 10:
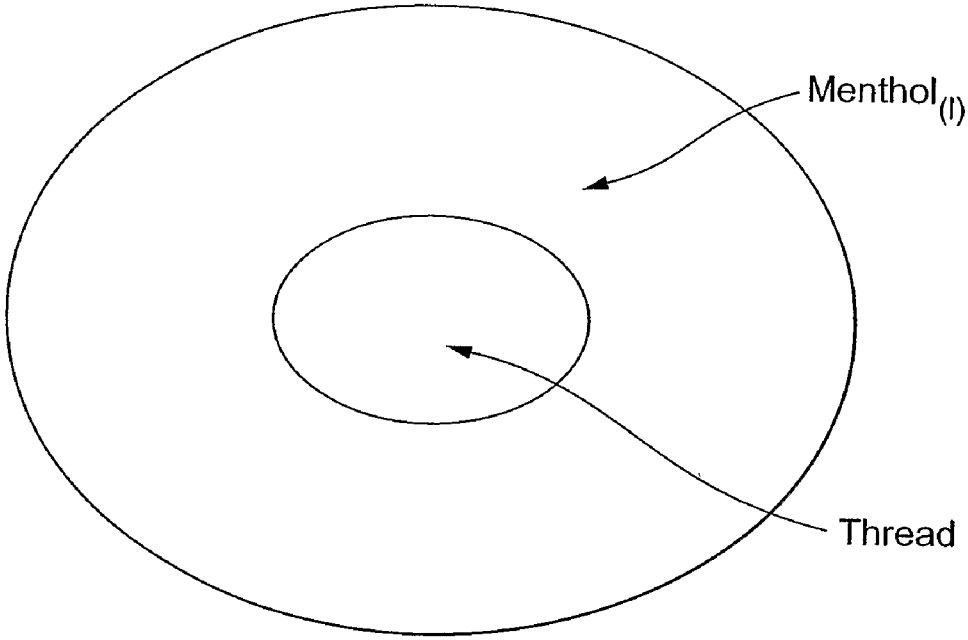

FIG. 10—which shows a diagrammatic representation of one aspect of the present invention.

SECTION A

With reference to FIG. 1: The rod (100) of the present invention has a first end (105) and a second end (110). The rod has located therein a solid support (115). The solid support (115) extends in a linear fashion from the first end (105) of said rod to the second end of said rod (110). At least a portion of said solid support is coated and/or impregnated with an additive (not shown).

With reference to FIG. 2: The prior art apparatus (200) comprises means (205) for providing tow (210). The tow (210) is bloomed (215). The apparatus (200) comprises means (220) for delivering a thread (225). The thread (225) passes through means (230) for contacting the thread (225) with menthol (not shown). The treated thread (235) then joins the tow (215) before passing through funnel (240). The apparatus also comprises rod forming means (245)—which comprises a conveyor belt (250) onto which is located paper (255). The covered rod (260) then passes through cutting means (265) to form smaller rods (270) for use in the preparation of cigarettes (not shown). The area boxed in is known as the garniture (labelled 275).

With reference to FIG. 3: The prior art apparatus (300) comprises means (not shown) for providing tow (not shown). The tow is bloomed (not shown). The apparatus (300) comprises means (320) for delivering a thread (325). The thread (325) passes through means (330) for contacting the thread (325) with menthol (not shown). The treated thread (335) then joins the tow (not shown) by-passing the stuffer (340) before they reach the garniture (labelled 375). The apparatus comprises a garniture (375) as the rod forming means—and comprises a conveyor belt (not shown) onto which is located paper (not shown). The covered rod (not shown) then passes through cutting means (not shown) to form smaller rods (not shown) for use in the preparation of cigarettes (not shown). Again, the area boxed in is known as the garniture (labelled 375).

With reference to FIG. 4: The apparatus of the present invention (400) comprises means a garniture (labelled 475)—which has been boxed in. The garniture comprises a conveyor belt (480) on which is carried bloomed tow (485) and paper (not shown). The apparatus (400) has means (490) for delivering into the garniture (475) thread (not shown). The apparatus (400) also has means (495) for delivering the additive (not shown)—such as menthol (not shown)—onto the tow (485) within the garniture (475).

The means (490) and (495) are shown as separate inlets. However, they may be co-axially arranged—e.g. means (490) may be within means (495). This is schematically shown in FIG. 10.

With reference to FIG. 6: In an alternative embodiment, the means (495) may be a pipe (500) that extends through a stuffer (505) and into the garniture (not shown).

With reference to FIG. 7: In an alternative embodiment, the means (495) may be a pipe (600) that by-passes the stuffer (605) and into the garniture (610).

With reference to FIG. 5: The filter rod making machine (22) operative to make filter rod according to the present invention is shown. Reference numeral 21 designates a garniture for making a rod according to the present invention—in particular a filter rod. In this embodiment, an upper run of a garniture tape 23 passes through the garniture 21 and is driven by a pulley 24 about which the tape 23 is trained. Near to the garniture 21 is disposed a stuffer 25 which is arranged to receive tow 26 to produce bloomed tow 26' and to direct the tow 26' forwards to the garniture 21. The filter rod making machine (22) has means (490) for delivering into the garniture (21) thread (not shown). The filter rod making machine (22) also has means (495) for delivering the additive (not shown)—such as menthol (not shown)—onto the support material (not shown) within the garniture (21).

Within the garniture 21 the thread (not shown) is enclosed in the tow 26, which in turn is wrapped in plugwrap (30) fed to the garniture 21 from reel 31. The continuous rod, designated 32, which issues from the outlet end of the garniture 21 is cut, by means of a blade indicated at 33, into discrete rod lengths 34. Each rod length 34 comprises a thread (not shown) and resembles the rod of FIG. 1.

Thus, the present invention as embodied by FIGS. 1 and 5 is as follows.

A method of preparing a rod (100, 34) for use in the preparation of a smoking article (not shown);

wherein said rod (100, 34) has a first end (105) and a second end (110);

wherein said rod (100, 34) has located therein a solid support (115);

wherein the solid support (115) extends in a linear fashion from the first end of said rod (105) to the second end of said rod (110);

wherein at least a portion of said solid support (115) is coated and/or impregnated with an additive (not shown);

wherein said rod is prepared using rod forming means (21), wherein said rod forming means comprises a channel (40) ending in an open exit (38), wherein material may pass through at least part of the channel and leave via the open exit in the form of a rod (32);

wherein said rod (100, 34) is prepared by:

(i) providing starting material (26') for forming said rod (100, 34);

(ii) providing the solid support (115) for location within said formed rod (100, 34);

(iii) providing an additive (not shown) for coating and/or impregnating at least a portion of said solid support (115);

(iv) allowing said starting material (26') to travel through at least part of said channel (40) of said rod forming means (21);

(v) coating and/or impregnating at least a portion of said solid support (115) with said additive (not shown) within said channel (40);

(vi) allowing said solid support (115) coated and/or impregnated with said additive (not shown) to travel through at least part of channel (40) of said rod forming means (21);

wherein said method comprises:

(a) contacting a section of said starting material (26') with a section of said solid support (115); wherein the initial contact of said section of starting material (26') with said section of said solid support (115) occurs in said rod forming means (21);

(b) allowing the contacted sections of starting material (26') and solid support (115) to travel through at least part of said channel (40) of said rod forming means (21) in the direction of said open exit (38);

(c) allowing the remainder of the starting material (26') and the remainder of the solid support (115) to contact in the rod forming means (21);

(d) allowing the contacted remainder of the starting material (26') and the solid support (115) to travel through at least part of said channel (40) of said rod forming means (21);

(e) forming said rod (32 or 100, 34) by said rod forming means (21), such that on forming said rod (32 or 100, 34) said solid support (115) extends within said rod (32 or 100, 34) from the first end of said rod (105) to the second end of said rod (110); and (f) allowing said formed rod (32 or 100, 34) to exit from said open exit (38).

The additive (here menthol) may be applied using a KDF-2 injection device produced by Kaymich—which heats menthol crystals and injects into centre of tow/filter, running at about 280-350 m/min. The menthol injection device may have a retractable nozzle to reduce menthol contamination of the machine. In the method, it is possible to pre-melt menthol(s) 50-60° C. and apply them onto the thread and therefore in to the centre of rod/tow stream. The method increases the menthol loading in the filter compared to a pre-mentholated thread inserted into the filter and allows increased speeds of filter production. By use of the apparatus of the present invention it may even be possible to have run rates of about 400 m/min (max 10 mg menthol onto a 27 mm filter).

SECTION B

As indicated earlier, preferably the support material enters the rod forming means via a port located in the former. In a preferred aspect, the position of the port is adjustable. Preferably, the port is adjustable in a direction perpendicular to the longitudinal axis of the channel.

As also indicated earlier, preferably the port is provided by a tube extending into said former. The tube may be in the form of a hollow needle. Preferably at least part of said tube extends along the inner space of said former whereby the end of said tube inside said former defines said port. Thus, in a preferred aspect, the positioning of the tube is adjustable. Preferably, the tube is adjustable in a direction perpendicular to the longitudinal axis of the channel.

FIGS. 8 and 9 present this preferred aspect of the present invention. With reference to these Figures, a head (700) is mounted (preferably detachably) to the support (702) at one end (704). The head (700) comprises two sections (706, 708) that are joined together by means of screws (710). Through a channel (712) is located a tube (790) which is the means for delivering into the garniture the support material—e.g. thread (not shown). A connector (792) is mounted to the end (794) of the tube (790) which receives the thread. The head (700) also houses means (716) that allow for adjustment of the tube (790) in the direction X (as shown on FIG. 9). In this instance, the means (716) comprises a screw that operably engages in a gear like manner the tube (790). The gearing of the screw is similar to that of a micrometer—such that (for example) 1.5 turns of the screw results in the end (798) of the tube (790) moving +1 mm or −1 mm depending on the direction of rotation of the screw (716).

Adjustable movement of the end (798) is very advantageous as it allows workers to make small adjustments before or during runs to increase the accuracy of the location of the support material (not shown in FIGS. 8 and 9). For example, it is possible to perform one or more initial runs using small lengths of a particular support material before embarking on a full run. This is important as the location of the support material within the tow may not be the same for different types of tow and/or the location thereof may also be dependent on input and output rates. Thus, by having an adjustable outlet (798) it allows a worker to fine tune the positioning of the support material in the rod (not shown). This may be of importance if centering of the support material is very important. With this embodiment it is possible to achieve substantial centering (such as exact centre or no more than 0.6 mm off centre, preferably no more than 0.4 mm off centre) for many different types of threads and tows simply by fine tuning the location of the outlet (798).

Various modifications and variations of the described aspects of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes of carrying out the invention which are obvious to those skilled in the relevant fields are intended to be within the scope of the following claims.

The invention claimed is:

1. A method of preparing a rod for use in the preparation of a smoking article;

wherein said rod has a first end and a second end;

wherein said rod has located therein a solid support;

wherein the solid support extends in a linear fashion from the first end of said rod to the second end of said rod;

wherein at least a portion of said solid support is coated and/or impregnated with an additive;

wherein said rod is prepared using rod forming means, wherein said rod forming means comprises a channel ending in an open exit, wherein material may pass through at least part of the channel and leave via the open exit in the form of a rod; wherein said rod is prepared by:

providing starting material for forming said rod;

providing the solid support for location within said formed rod;

providing an additive for coating and/or impregnating at least a portion of said solid support;

allowing said starting material to travel through at least part of said channel of said rod forming means;

coating and/or impregnating at least a portion of said solid support with said additive within said channel;

allowing said solid support coated and/or impregnated with said additive to travel through at least part of channel of said rod forming means;

wherein said method comprises:

contacting a section of said starting material with a section of said solid support; wherein the initial contact of said section of starting material with said section of said solid support occurs in said rod forming means;

allowing the contacted sections of starting material and solid support to travel through at least part of said channel of said rod forming means in the direction of said open exit;

allowing the remainder of the starting material and the remainder of the solid support to contact in the rod forming means;

allowing the contacted remainder of the starting material and the solid support to travel through at least part of said channel of said rod forming means;

forming said rod by said rod forming means, such that on forming said rod said solid support extends within said rod from the first end of said rod to the second end of said rod; and allowing said formed rod to exit from said open exit.

2. A method according to claim 1 wherein all of said solid support is coated with an additive.

3. A method according to claim 1 wherein at least a part of the external surface of said rod is covered with a cover.

4. A method according to claim 3 wherein said cover is paper.

5. A method according to claim 3 wherein the edges of said cover are fixed to each other by means of an adhesive.

6. A method according to claim 5 wherein said adhesive is a hot melt adhesive.

7. A method according to claim 1 wherein said rod is subsequently cut into a smaller rod for use in the preparation of a smoking article.

8. A method according to claim 1 wherein said rod or smaller rod is a filter rod.

9. A method according to claim 1 wherein said smoking article is a cigarette.

10. A method according to claim 1 wherein said support material enters the rod forming means via a port that is operably linked to the channel.

11. A method according to claim 1 wherein said solid support is positioned along the central longitudinal axis of the rod.

12. A method according to claim 1 wherein the additive is a smoke-modifying agent.

13. A method according to claim 1 wherein the additive is a flavourant.

14. A method according to claim 1 wherein the additive is a flavourant in substantially pure form.

15. A method according to claim 1 wherein said additive is menthol.

16. A method according to claim 1 wherein at least one end of the solid material is at one end of the rod.

17. A method according to claim 1 wherein the ends of the solid material are at opposite ends of the rod.

18. A method according to claim 1 wherein said section of said starting material is an end of said starting material.

19. A method according to claim 1 wherein said section of said solid support is an end of said solid support.

20. A method according to claim 1 wherein said starting material enters the channel at an open entrance opposite the open exit.

21. A method according to claim 1 wherein said channel is conical.

22. A method according to claim 1 wherein said rod forming means comprises a garniture.

23. A method according to claim 22 wherein the initial coating or impregnation of said portion of said solid support with an additive occurs whilst the solid support is located in the garniture.

24. A method according to claim 22 wherein the initial contact of the solid support with said starting material occurs whilst the starting material is located in the garniture.

25. A method according to claim 1 wherein said rod forming means comprises a garniture defining said channel.

26. A method according to claim 1 wherein said starting material is of a planar shape.

27. A method according to claim 1 wherein said starting material is cellulosic.

28. A method according to claim 1 wherein said starting material is cellulose acetate.

29. A method according to claim 1 wherein starting material is tow.

30. A method according to claim 1 wherein starting material is bloomed tow.

31. A method according to claim 1 wherein at least a portion of the starting material may be modified by coating and/or impregnating thereon and/or admixing therewith an additive.

32. A method according to claim 31 wherein the additive is a smoke-modifying agent.

33. A method according to claim 32 wherein the smoke-modifying agent is a flavourant.

34. A method according to claim 33 wherein said flavourant is menthol.

35. A method according to claim 1 wherein said solid support is a thread or a tape.

36. A method according to claim 35 wherein said solid support is a thread.

37. A method according to claim 1 wherein said solid support is coloured.

38. A method according to claim 1 wherein said solid support is coloured and wherein the colour is indicative or suggestive of the smoke modifying agent.

39. A method according to claim 1 wherein said solid support is coloured green.

40. A method according to claim 1 wherein said rod forming means is formed from at least two components that operably engage each other to form said channel.

41. A method according to claim 40 wherein the first component is a former in the shape of a tapered cone.

42. A method according to claim 41 wherein said support material enters the rod forming means via a port located in the former.

43. A method according to claim 42 wherein said port is provided by a tube extending into said former.

44. A method according to claim 42 wherein at least part of said tube extends along the inner space of said former whereby the end of said tube inside said former defines said port.

45. A method according to claim 42 wherein said port is adjustable.

46. A method according to claim 45 wherein said port is adjustable in a direction perpendicular to the longitudinal axis of the channel.

47. A method according to claim 45 wherein said rod is used to prepare a smoking article.

48. A method according to claim 47 wherein said smoking article is a cigarette.

49. A method according to claim 40 wherein the second component is a conveyor belt.

50. A method according to claim 49 wherein said starting material is carried by said conveyor belt.

51. A method according to claim 49 wherein said starting material is carried on paper by said conveyor belt.

52. A method according to claim 51 wherein said paper provides a covering for said rod.

53. A method according to claim 52 wherein at least one edge of said paper carries an adhesive.

54. A method according to claim 53 wherein said adhesive is a hot melt adhesive.

55. A method according to claim 40 wherein the first component is a former in the shape of a tapered cone having a longitudinal opening and wherein the second component is a conveyor belt operably connectable with said opening.

56. A method according to claim 1 wherein said rod is used to prepare a smoking article.

57. A method according to claim 56 wherein said smoking article is a cigarette.

58. A method of preparing a rod for use in the preparation of a smoking article; wherein the rod has a first end and a second end; wherein the rod has located therein a solid support; wherein the solid support extends in a linear fashion from the first end of said rod to the second end of said rod; wherein at least a portion of said solid support is coated and/or impregnated with an additive; wherein the rod is prepared using rod forming means, wherein said rod forming means comprises a channel ending in an open exit, wherein material may pass through at least part of the channel and leave via the open exit in the form of a rod; wherein the rod is prepared by:

providing starting material for forming said rod;

providing the solid support for location within said formed rod;

providing an additive for coating and/or impregnating at least a portion of said solid support; wherein the initial contact of the solid support with the additive occurs in said rod forming means; and contacting a section of said starting material with a section of said solid support; wherein the initial contact of said section of starting material with said section of said solid support occurs in said rod forming means.

59. A method according to claim 58 wherein said rod is used to prepare a smoking article.

60. A method according to claim 59 wherein said smoking article is a cigarette.

61. An apparatus for preparing a rod suitable for use in the preparation of a smoking article;

wherein said rod has a first end and a second end;

wherein said rod has located therein a solid support;

wherein the solid support extends in a linear fashion from the first end of said rod to the second end of said rod;

wherein at least a portion of said solid support is coated and/or impregnated with an additive;

wherein said rod forming means comprises:

a channel ending in an open exit means for allowing material to pass through at least part of the channel and leave via the open exit in the form of a rod;

means for providing starting material for forming said rod;

means for providing the solid support for location within said formed rod;

means for providing an additive for coating and/or impregnating at least a portion of said solid support;

means for coating and/or impregnating at least a portion of said solid support with said additive within said channel;

means for allowing a section of said starting material to contact a section of said solid support coated and/or impregnated with said additive within said channel;

means for allowing said solid support coated and/or impregnated with said additive to travel through at least part of channel of said rod forming means;

means for allowing said formed rod to exit from said open exit.

62. An apparatus for preparing a rod suitable for use in the preparation of a smoking article;

wherein said rod has a first end and a second end;

wherein said rod has located therein a solid support;

wherein the solid support extends in a linear fashion from the first end of said rod to the second end of said rod;

wherein at least a portion of said solid support is coated and/or impregnated with an additive;

wherein said rod forming means comprises:

a channel ending in an open exit means for allowing material to pass through at least part of the channel and leave via the open exit in the form of a rod;

means for providing starting material for forming said rod;

means for providing the solid support for location within said formed rod;

means for providing an additive for coating and/or impregnating at least a portion of said solid support;

means for coating and/or impregnating at least a portion of said solid support with said additive within said channel;

means for allowing a section of said starting material to contact a section of said solid support coated and/or impregnated with said additive within said channel;

means for allowing said solid support coated and/or impregnated with said additive to travel through at least part of channel of said rod forming means;

means for allowing said formed rod to exit from said open exit wherein said rod forming means comprises a garniture defining said channel;

wherein the initial coating or impregnation of said portion of said solid support with an additive occurs whilst the solid support is located in the garniture; and wherein the initial contact of the solid support with said starting material occurs whilst the starting material is located in the garniture.

63. An apparatus for preparing a rod suitable for use in the preparation of a smoking article; wherein said rod has a first end and a second end; wherein said rod has located therein a solid support; wherein the solid support extends in a linear fashion from the first end of said rod to the second end of said rod; wherein at least a portion of said solid support is coated and/or impregnated with an additive; wherein said apparatus comprises a rod forming means; wherein said rod forming means comprises: a channel ending in an open exit; means for providing starting material for forming said rod; means for providing the solid support for location within said formed rod; means for providing an additive for coating and/or impregnating at least a portion of said solid support; means for coating and/or impregnating at least a portion of said solid support with said additive within said channel, wherein the initial contact of the solid support with the additive occurs in said rod forming means; means for allowing a section of said starting material to contact a section of said solid support coated and/or impregnated with said additive within said channel, wherein the initial contact of said section of starting material with said section of said solid support occurs in said rod forming means.

* * * * *

UNITED STATES PATENT AND TRADEMARK OFFICE

CERTIFICATE OF CORRECTION

PATENT NO. : 8,381,736 B2
APPLICATION NO. : 12/162328
DATED : February 26, 2013
INVENTOR(S) : White et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 996 days.

Signed and Sealed this
Seventeenth Day of September, 2013

Teresa Stanek Rea
*Deputy Director of the United States Patent and Trademark Office*